US008752310B1

(12) United States Patent
Smith, III

(10) Patent No.: US 8,752,310 B1
(45) Date of Patent: Jun. 17, 2014

(54) INTERNALLY ILLUMINATED FOOTWEAR COMPONENT

(71) Applicant: Roy Robert Smith, III, Sugar Land, TX (US)

(72) Inventor: Roy Robert Smith, III, Sugar Land, TX (US)

( * ) Notice: Subject to any disclaimer, the term of this patent is extended or adjusted under 35 U.S.C. 154(b) by 0 days.

(21) Appl. No.: 13/688,745

(22) Filed: Nov. 29, 2012

(51) Int. Cl.

| | |
|---|---|
| ***A43B 23/00*** | (2006.01) |
| ***A43B 21/28*** | (2006.01) |
| ***A43B 3/00*** | (2006.01) |
| ***A43B 1/00*** | (2006.01) |

(52) U.S. Cl.
CPC ..... *A43B 3/001* (2013.01); *A43B 1/0072* (2013.01); *A43B 1/0027* (2013.01)
USPC ..... 36/137; 362/103; 36/25 R

(58) Field of Classification Search
CPC .. A43B 1/0036; A43B 1/0072; A43B 1/0027; A43B 3/0005; A43B 3/001
USPC ..... 36/137, 132, 136, 25 R, 112; 362/103, 362/276, 806, 249.02, 231
See application file for complete search history.

(56) References Cited

U.S. PATENT DOCUMENTS

| | | | | |
|---|---|---|---|---|
| 4,712,314 | A * | 12/1987 | Sigoloff | 36/112 |
| 5,860,727 | A * | 1/1999 | Chien | 362/84 |
| 5,865,523 | A * | 2/1999 | Chien | 362/84 |
| 6,112,437 | A * | 9/2000 | Lovitt | 36/137 |
| 6,443,590 | B1 * | 9/2002 | Lovitt | 362/103 |
| 7,421,806 | B2 * | 9/2008 | Braynock et al. | 36/100 |
| 7,841,108 | B2 * | 11/2010 | Johnson et al. | 36/136 |
| 7,937,856 | B2 * | 5/2011 | Cook et al. | 36/137 |
| 8,356,430 | B2 * | 1/2013 | Beers | 36/137 |
| 2012/0260532 | A1 * | 10/2012 | Catalano | 36/103 |
| 2013/0125416 | A1 * | 5/2013 | Hoffer et al. | 36/83 |

* cited by examiner

*Primary Examiner* — Jila M Mohandesi

(57) ABSTRACT

The sole section of a shoe includes a midsole and an outsole, with the midsole being made from a translucent material. An illumination system is located inside the translucent midsole, causing the translucent midsole to be internally illuminated when the illumination system is active. Due to the translucent nature of the midsole light from the illumination system reflects internally throughout the midsole, increasing illumination. The light will also illuminate adjacent translucent components, such as the outsole if it is also made from a translucent material. Light from the illumination system can be blocked, such as by an opaque outsole or colored mold injection, and used to form an illuminated design or logo. By blacking out or covering sections of the translucent midsole, shapes and letters of visible light can be created in the negative space of the obstruction sections. This allows illuminated designs to easily be incorporated into footwear.

10 Claims, 30 Drawing Sheets

INTERNALLY ILLUMINATED FOOTWEAR COMPONENT

FIELD OF THE INVENTION

The present invention relates generally to a footwear component with an internal illumination system and means of displaying graphics and designs by selectively covering light from the internal illumination system.

BACKGROUND OF THE INVENTION

Using light as an accessory to footwear is commonly employed and has been for some time. Shoes, sneakers or otherwise, have been given various arrangements of lighting systems to enhance visual appeal of the shoe, especially towards children. Often times the lights are external to the shoe, and serve as an accessory rather than an integral part of the shoe, simply lighting up the outside areas of the shoe. Generally, the lights do not internally illuminate the shoe, instead providing illumination external to the shoe.

While there are examples of footwear with internal lighting systems, current methods of lighting a shoe can still use improvement. Some solutions simply place a few lighting elements inside the shoe, perhaps in a transparent compartment. While certainly internal to the shoe, these lighting elements don't really provide internal illumination. Some products hollow out sections of shoes, where lights are placed. Sometimes these hollowed sections have components inside, which are illuminated by the lights. Other times the sections are empty, showing light along the internal walls. These examples provide some measure of internal illumination, but leave much to be desired. Generally, only small portions of the shoe are illuminated, and even then, the shoe itself is not illuminated so much as are various components and internal surfaces which are located in the illuminated section.

It is therefore an object of the present invention to provide an internally illuminated component for a shoe. It is a further object of the present invention, to provide a method of obstructing the internal illumination, to create visual designs along the external surface, of the internally illuminated component.

DETAIL DESCRIPTIONS OF THE INVENTION

All illustrations of the drawings are for the purpose of describing selected versions of the present invention and are not intended to limit the scope of the present invention.

An internally illuminated footwear component comprises a sole section 1, an illumination system 2, and an illumination housing 3, shown in FIG. 1, FIG. 2, FIG. 3, and FIG. 4. The illumination housing 3 is located within the midsole area and is designed to receive the illumination system 2. Since the illumination system 2 is placed within the midsole area, the resulting footwear component is internally illuminated.

Figure 1:
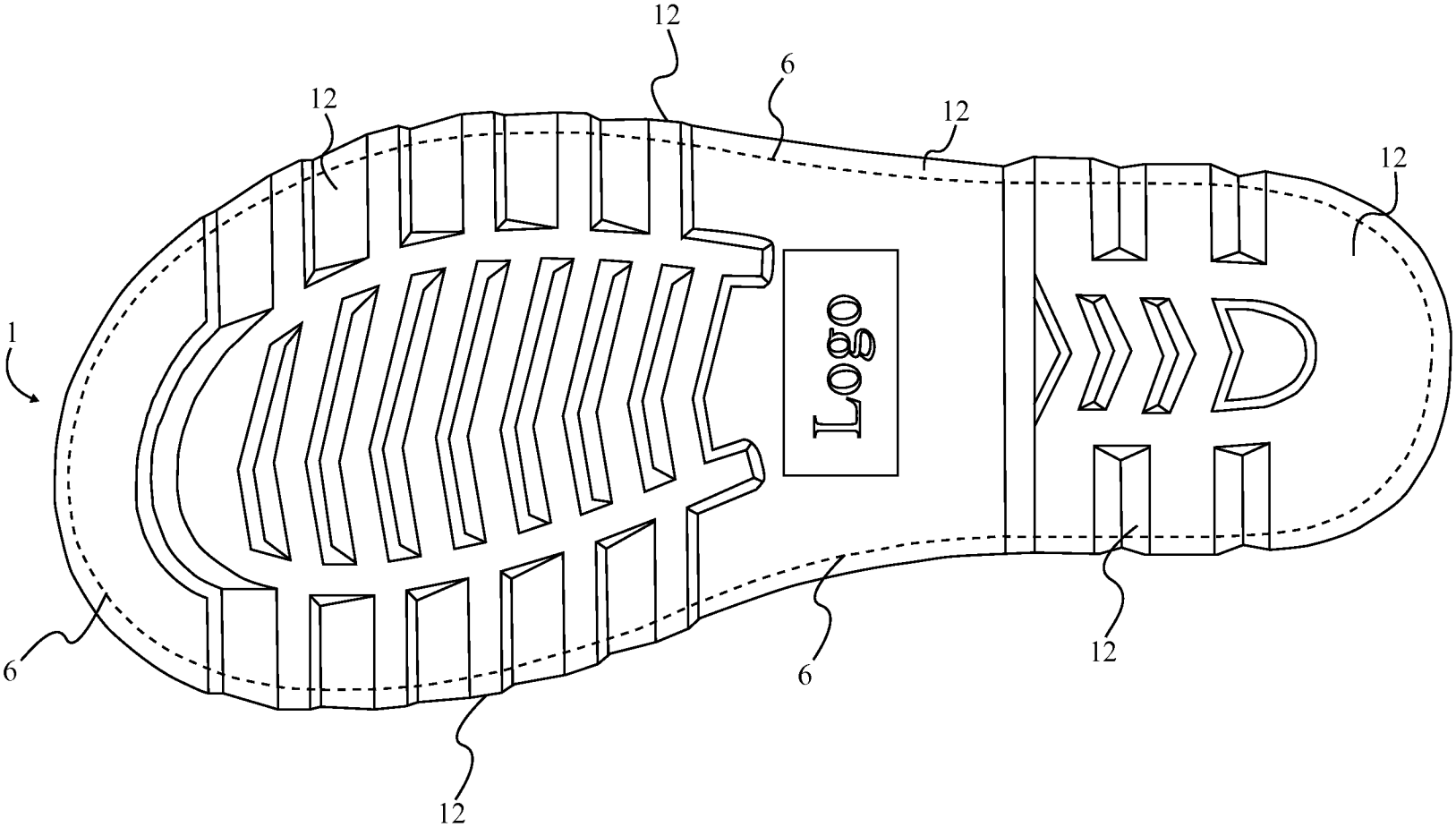
FIG. 1 is a bottom view of the preferred embodiment of the present invention, which embodies a singularly molded sole section.
Figure 2:
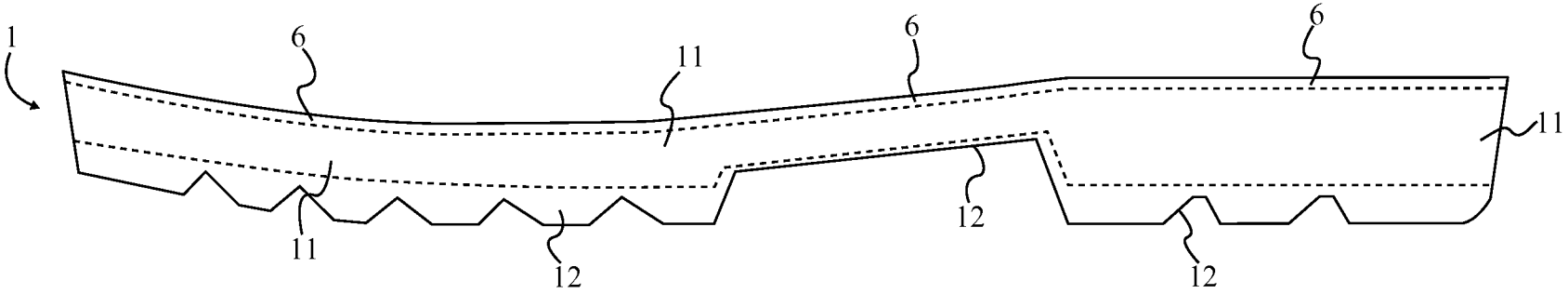
FIG. 2 is a side view of the preferred embodiment of the present invention, which embodies a singularly molded sole section.
Figure 3:
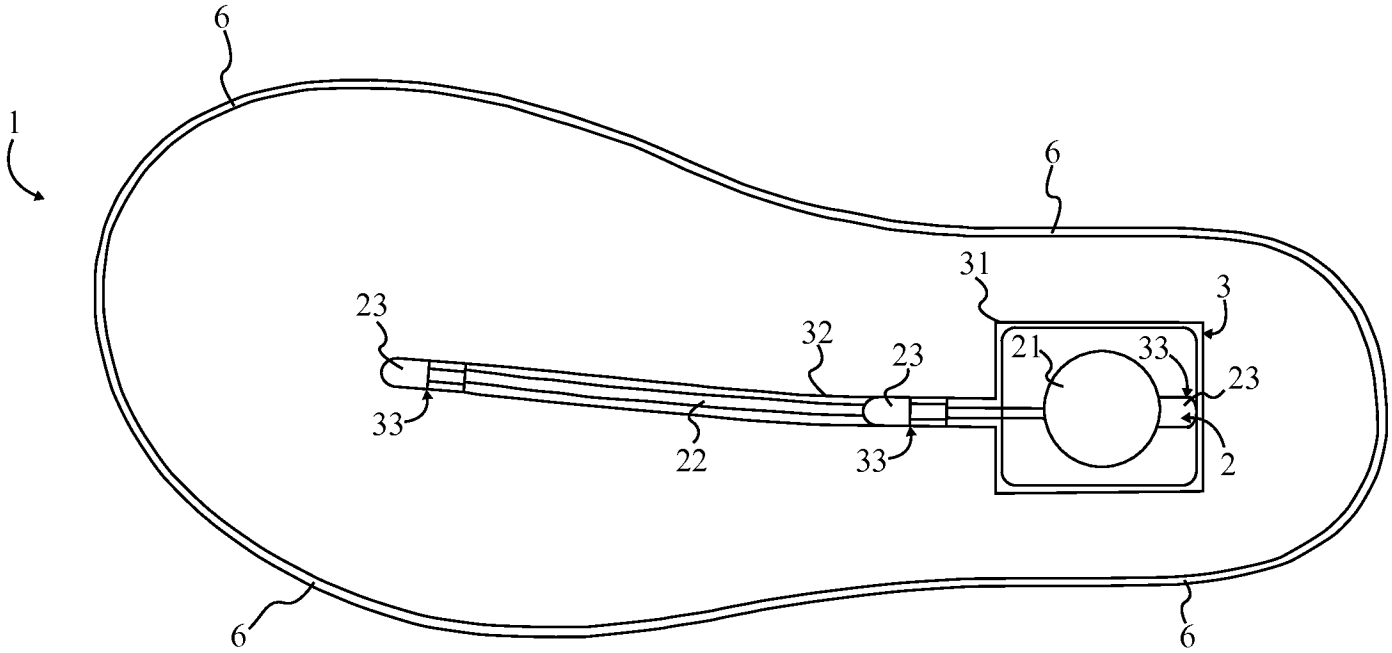
FIG. 3 is a top internal view of the preferred embodiment of the present invention, which embodies a singularly molded sole section.
Figure 4:
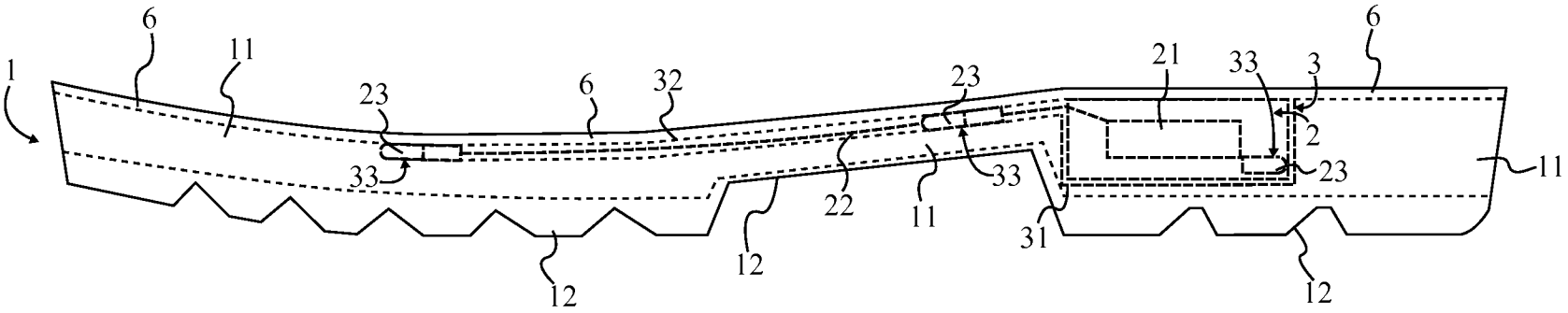
FIG. 4 is a side internal view of the preferred embodiment of the present invention, which embodies a singularly molded sole section.

The sole section 1 further comprises a translucent midsole 11 and translucent outsole 12, which themselves are respectively positioned in the midsole area and an outsole area. In the preferred embodiment, this sole section 1 is molded as a single translucent component, as depicted in FIG. 2 and FIG. 4. The translucent midsole 11, which includes the illumination housing 3 illustrated in FIG. 3 and FIG. 4, is located above the translucent outsole 12, which itself comprises a tread pattern along a bottom face. Atop the sole section 1, positioned around the perimeter of the translucent midsole 11, is a welt 6 that forms a wall around the translucent midsole 11. Visible in FIG. 3, this welt 6 is also known as a lip, and is common to many footwear designs. This sole section 1 is integral to the functioning of the present invention. The sole section 1 can be used in various types of footwear designs, providing both the required internal support and external hardiness needed for the common footwear. The translucent nature of the sole section 1 allows the sole section 1 to be internally illuminated by the illumination system 2, which is installed in the illumination housing 3 located in the translucent midsole 11. Due to the translucent properties of the sole section 1, the light from the illumination system 2 travels throughout both the translucent midsole 11 and translucent outsole 12, providing a visually appealing internally illuminated display.

Figure 5:
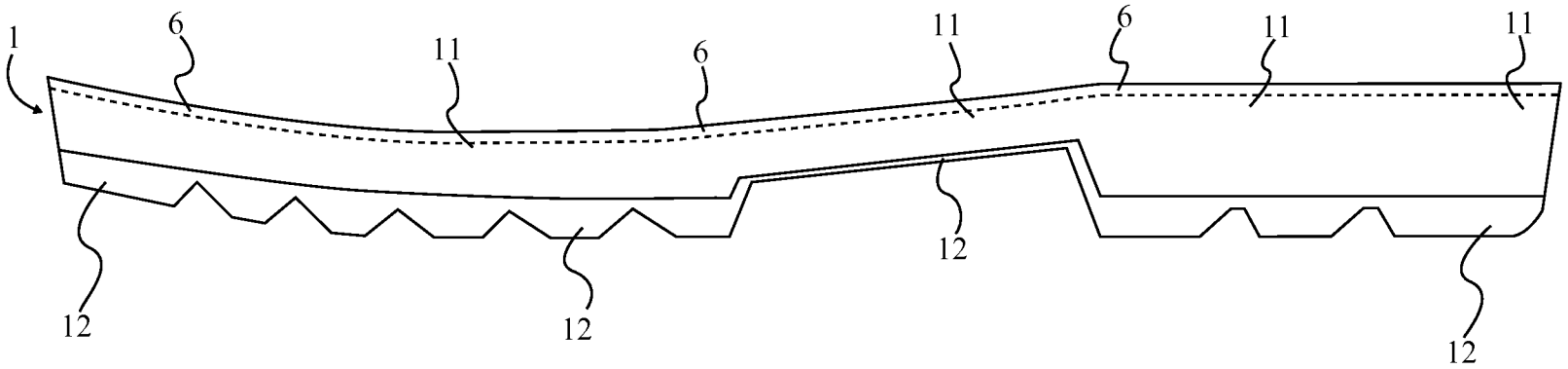
FIG. 5 is a side view of an alternative embodiment of the present invention.

Though the preferred embodiment describes the present invention as being a singularly, solid molded component, that being the sole section 1, it is also possible to mold the sole section 1 as separate pieces. In such a variation, the translucent midsole 11 would be molded independently from the translucent outsole 12. The two individual components would then be connected to form the whole sole section 1. In this variation, the sole section 1 is essentially identical to that of the preferred embodiment, with the only key difference being the assembly method. The illumination system 2 and illumination housing 3 are still located in the translucent midsole 11, while the welt 6 remains atop and around the translucent midsole 11. Likewise, the bottom face of the translucent outsole 12 contains a tread pattern. Examples of this variation can be seen in FIG. 5 and FIG. 6.

Figure 7:
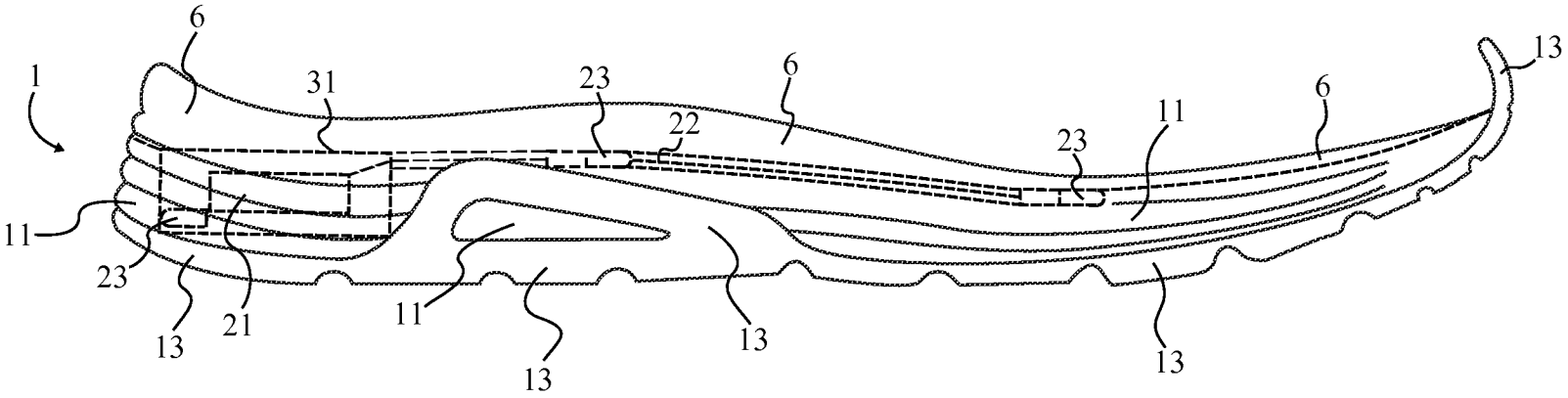
FIG. 7 is a side internal view of another embodiment of the present invention.

In another embodiment, the sole section 1 comprises a translucent midsole 11 and an opaque outsole 13. This embodiment shares many aspects with the preferred embodiment. Located in the translucent midsole 11 is an illumination housing 3, which itself contains an illumination system 2. The translucent midsole 11 also includes a welt 6, positioned around the top of the translucent midsole 11. The opaque outsole 13, similar to the translucent outsole 12 of the preferred embodiment, includes a tread pattern along the bottom face. The differences in this other embodiment are related to the opaque outsole 13. The opaque outsole 13 obstructs views of the internally illuminated translucent midsole 11, preventing the translucent midsole 11 from being seen from the bottom face of the footwear; as a result, only the outer side surfaces of the translucent midsole 13 is illuminated. To take advantage of this, sections of the opaque outsole 13 can be removed, allowing corresponding sections of the translucent midsole 11 to be seen through the cut areas of the opaque outsole 13. By removing specific areas, logos, designs, and other illustrations can be formed in the opaque outsole 13. Since the internally illuminated translucent midsole 11 is visible through these areas, the logos, designs, and other illustrations appear to be illuminated. There are different ways of implementing these areas, discussed later as blackout methods. An example of an opaque outsole 13 is shown in FIG. 7, where the outsole actually wraps around the side of the footwear and creates a design along the side of the translucent midsole 11. The illustration in FIG. 7 depicts a sole section 1 where the translucent midsole 11 and opaque outsole 13 may be created from either a single multicolor mold or from separately molded components.

As mentioned in the above other embodiment, the sole section 1 can be built from a single mold, or assembled from two molds. Since the translucent midsole 11 and opaque outsole 13 have different properties, a multicolor mold is needed if the sole section 1 is built from a single mold. Alternatively, if the translucent midsole 11 and opaque outsole 13 are molded individually, the two components can be connected to form the sole section 1.

Figure 6:
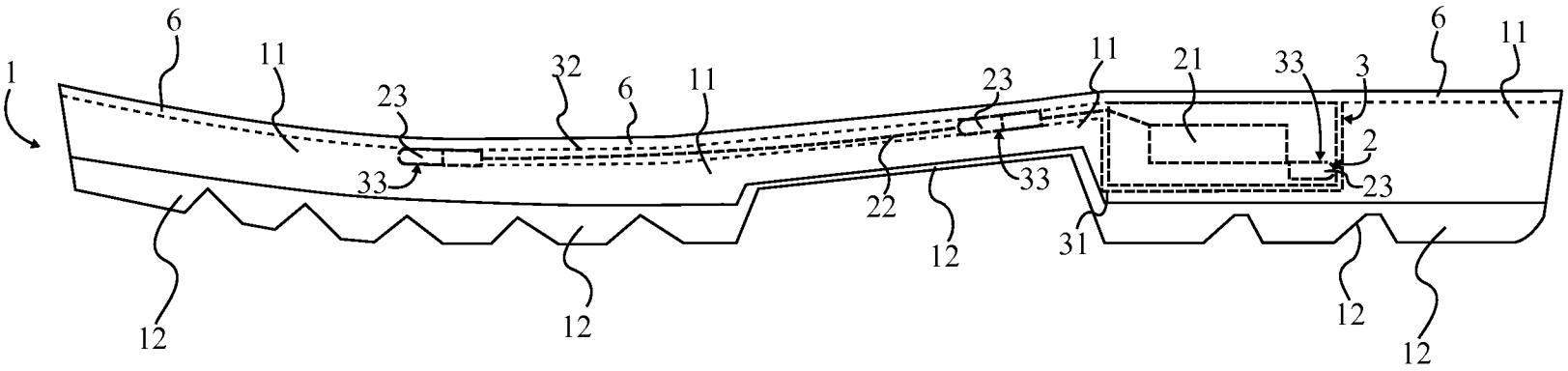
FIG. 6 is a side internal view of an alternative embodiment of the present invention.
Figure 8:
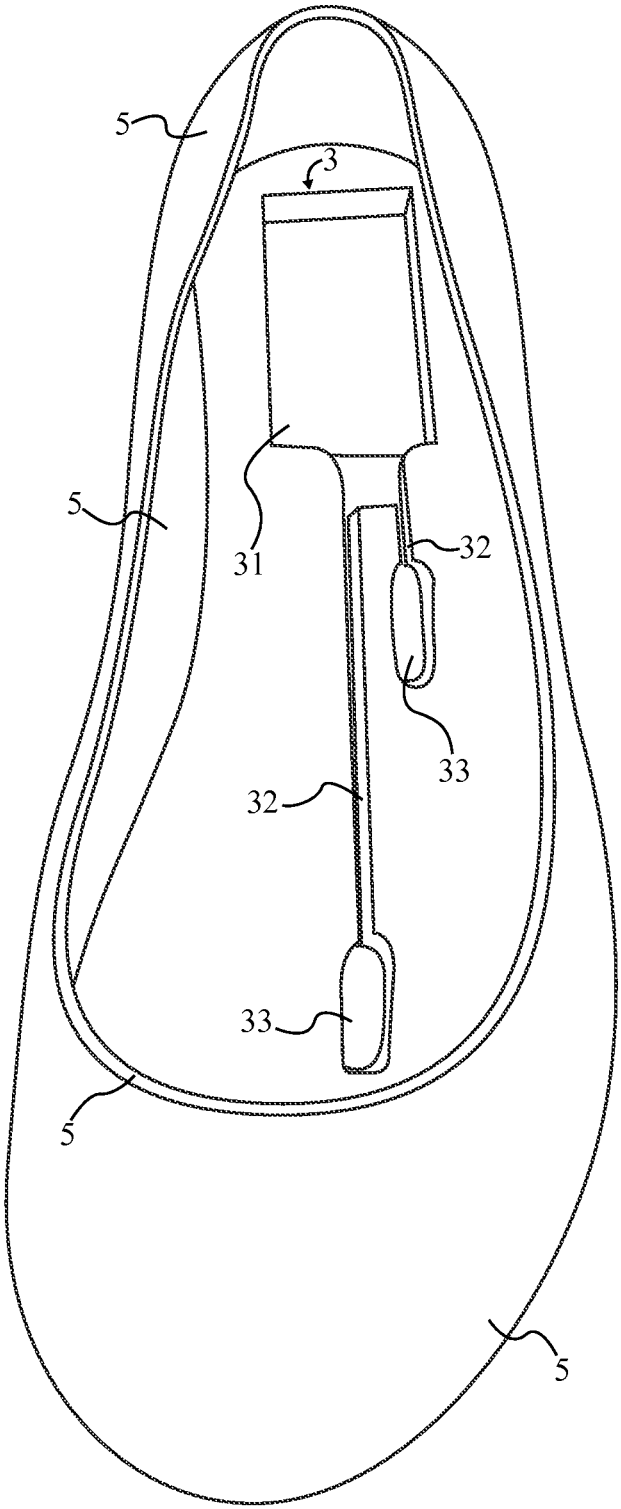
FIG. 8 is a top perspective view of an additional embodiment of the present invention.
Figure 9:
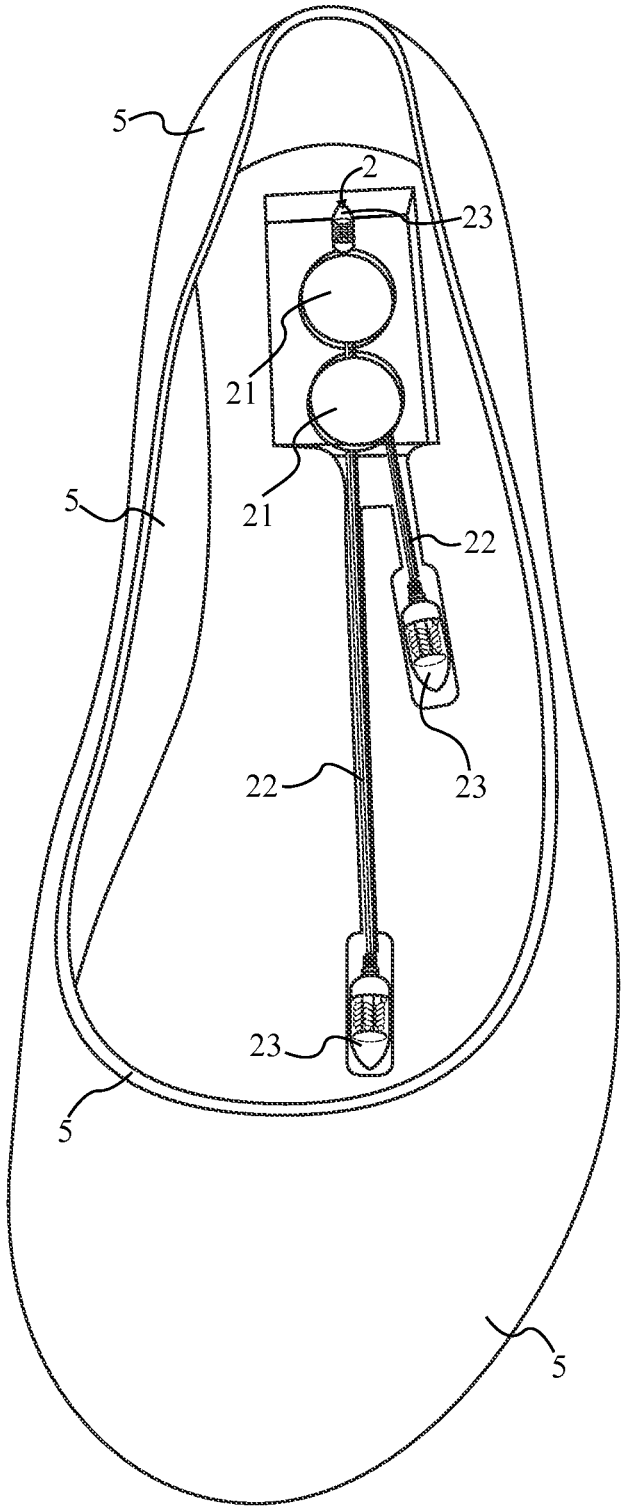
FIG. 9 is a top perspective view showing the illumination system of an additional embodiment of the present invention.

In a third embodiment, seen in FIG. 8 and FIG. 9, the sole section 1 is integrated into the full shoe, commonly referred to as "jellies". Jellies are a type of footwear that is created from a mold. With a jelly, the sole section 1 is often created as part of the same component as the full shoe, unlike other methods where the sole section 1 is created independently and later used as a base for other components, such as a shoe upper 5. In the present invention, the jelly is molded from a translucent material that is internally illuminated by the illumination system 2. As the jelly represents a footwear that is entirely translucent, the entire jelly footwear is internally illuminated. Since the illumination housing 3, and thus system, are located in the sole section 1, the light from the illumination system 2 travels from the translucent midsole 11 and translucent outsole 12 to the translucent upper 5. As a result, 100% of the jelly footwear, including the translucent midsole 11, translucent outsole 12, and upper 5, is illuminated. In the preferred embodiment the illumination housing 3 is cut into the top of the translucent midsole 11, illustrated in FIG. 3. The illumination housing 3 comprises a power section 31, a plurality of channels 32, and a plurality of illumination sections 33. The illumination housing 3 is aligned so that the illumination system 2 is parallel with the top of the translucent midsole 11, as well as being positioned so that the top of the illumination system 2 touches or nearly touches the plane of the top surface of the translucent midsole 11, as illustrated in FIG. 4, FIG. 6, and FIG. 7. Each part of the illumination housing 3 is designed to contain a specific part of the illumination system 2. Due to this, either a single channel or plurality of channels 32 run from the power section 31 to the plurality of illumination sections 33, as illustrated in FIG. 3 and FIG. 8. In this preferred embodiment, the illumination system 2 is held in place by friction. Since the illumination housing 3 is cut into the top of the translucent midsole 11, the illumination system 2 may be accessed even after a shoe is assembled. This is done by removing the footbed, insole, insert, or any other interfering components (which varies with the type of shoe) that may be between the shoe interior and the translucent midsole 11. One such example of an additional interfering component is the lasting board. The lasting board serves as the main connection point between a separately built upper and the midsole, and is ubiquitous in shoe manufacturing. The separately built upper is often stitched or glued to the lasting board, while the lasting board itself is glued to the top of the midsole, thus connecting the shoe's separately built upper to the midsole. Since the lasting board covers the translucent midsole 11, and thus the illumination housing 3, a means of access must be provided if a manufacturer wants the illumination system 2 to be accessible. There are two variations of providing access through the lasting board.

One option is to cut access holes in the lasting board prior to connecting the separately built upper to the lasting board. The access holes correspond in shape and size to the illumination housing 3. The access holes in the lasting board would be slightly larger in size than the illumination housing 3, thus allowing for easier alignment of the lasting board with the illumination housing 3 during the manufacturing process. Alternatively, the access holes can be cut from the lasting board after connecting the separately built upper to the lasting board. As with the first option, this will still result in access holes that expose the illumination housing 3, visible after removing the footbed or insole.

In other embodiments, where the translucent midsole 11 is molded separate from the outsole, the illumination housing 3 could alternatively be cut into the bottom of the translucent midsole 11, rather than the top. In this configuration, the illumination system 2 is held in place by friction as well as the outsole. Prior to connecting the outsole to the translucent midsole 11, the illumination system 2 must be placed in the illumination housing 3. After the outsole is connected to the translucent midsole 11 the illumination system 2 will no longer be accessible, unless the maker designs an outsole which is removable from the translucent midsole 11. This is in contrast to the preferred embodiment, where the illumination system 2 may be accessed from the top by removing a shoe insert.

The illumination system 2 comprises a power source 21, a plurality of electrical wires 22, and a plurality of illumination sources 23, examples of which can be seen in FIG. 3, FIG. 4, and FIG. 9. As shown in FIG. 3, FIG. 4, FIG. 8, and FIG. 9, the power source 21 is located in the power section 31 of the illumination housing 3. The plurality of electrical wires 22 are placed in the plurality of channels 32. Likewise, the plurality of illumination sources 23 are located in the plurality of illumination sections 33 of the illumination housing 3. The plurality of illumination sources 23 are provided power from the power source 21 by the plurality of electrical wires 22, connecting the power source 21 to the plurality of illumination sources 23. The illumination sources 23 are preferably light-emitting diodes (LEDs), oriented so that light travels parallel to the plane of the translucent midsole 11. Light originating from the LEDs is affected as it approaches the edge of the translucent midsole 11. Some of the light from the LEDs will continue through the edge of the translucent midsole 11, perhaps refracting, but still leaving the translucent midsole 11. The light that is not transmitted will be internally reflected at the barrier between the translucent midsole 11 and the outside area. This internally reflected light will continue travelling within the translucent midsole 11 until reaching another edge of the translucent midsole 11, where the light will either be transmitted, refracted, or internally reflected again. Due to the internal reflection of the light, only a few LEDs need to be included to provide the desired internal illumination for the translucent midsole 11 or "jelly" type footwear.

A wide variety of LEDs are available and can be used to achieve different effects as part of the illumination system 2. In addition to being available in different colors, LEDs can have different brightness values and viewing angles. LEDs with narrower viewing angles can be used to provide more intense beams of light, while larger viewing angles will provide a wider, more diffuse coverage of the translucent midsole 11. LEDs with different colors and brightness can be used together to create colorful and intriguing visual displays. A large amount of combinations are possible given the variety of LEDs in terms of color and other attributes.

In all embodiments, a variety of "blackout" methods can be implemented. The blackout methods are ways of blocking light from the internally illuminated translucent midsole 11 (and translucent outsole 12, when applicable). By strategically blocking light, it is possible to incorporate designs, logos, and other embellishments with the present invention. There are six different implementations of the blackout method. Each variation of the blackout method uses a plurality of outsole design sections 131, while some also require the use of a plurality of design inserts 14. The outsole design sections 131 and design inserts 14 can take numerous forms, depending on the intended overall design. A common and simple design is a word across the sole of the footwear, such as the name of the product or brand. In this instance, the individual outsole design sections 131 and design inserts 14 are simply the letters that form the product name.

Figure 10:
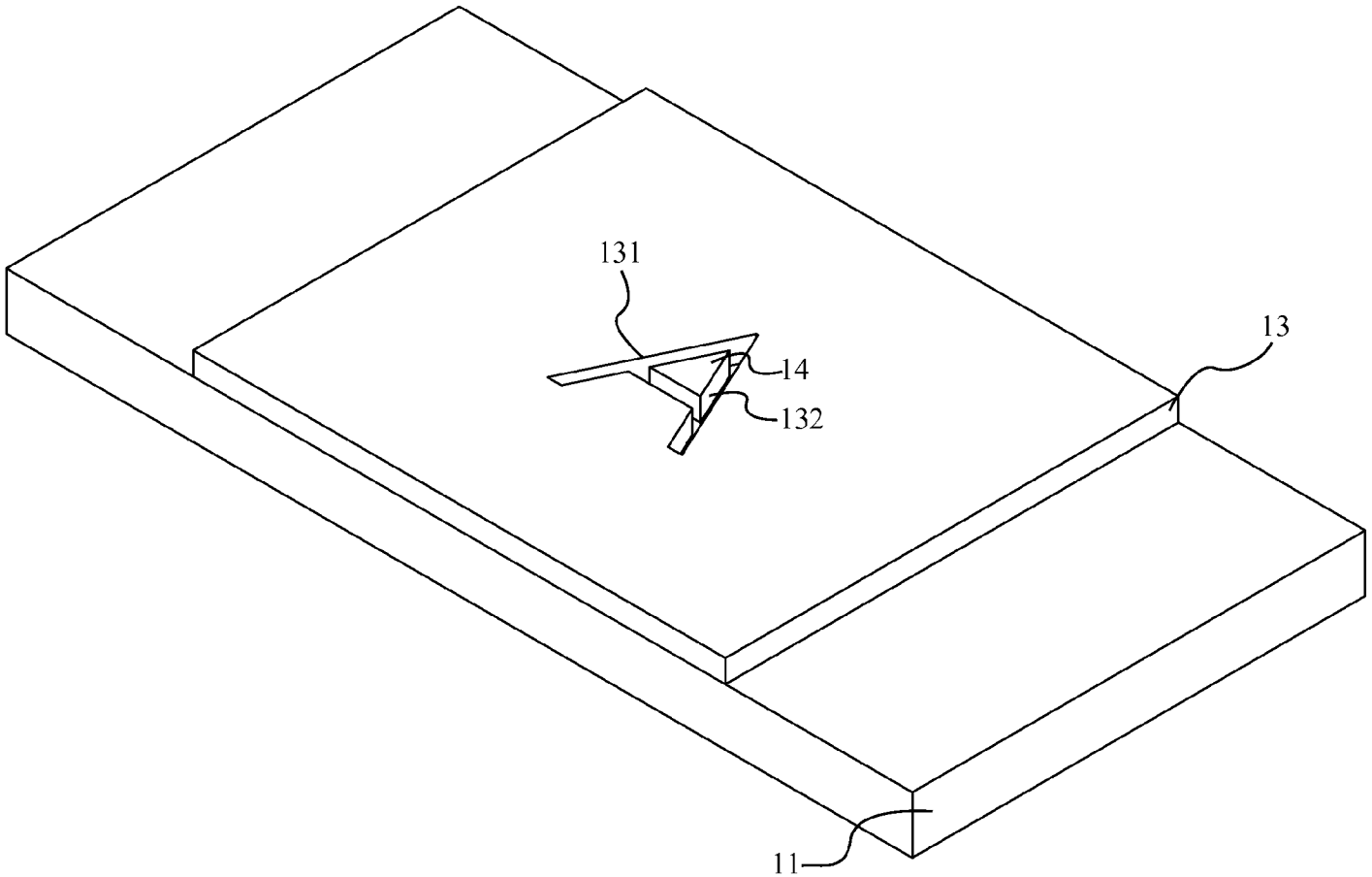
FIG. 10 is a perspective view showing a first blackout method of one embodiment of the present invention.

The first blackout method, shown in FIG. 10, utilizes the plurality of outsole design sections 131 and the plurality of design inserts 14. In this first blackout method, the outsole design sections 131 are cut from the opaque outsole 13, creating a plurality of cavities 132. This results in parts of the translucent midsole 11 being exposed through the outsole design sections 131 cut from the opaque outsole 13. Molded as part of the translucent midsole 11 and aligned with the outsole design sections 131 is the plurality of design inserts 14. These design inserts 14 slightly protrude from the translucent midsole 11, such that the design inserts 14 will traverse into the outsole design sections 131 when the opaque outsole 13 is connected to the translucent midsole 11. As a result, when the sole section 1 is viewed from the bottom, the design (e.g. product name) is defined by the outsole design sections 131. It essentially appears that the design is illuminated, even though only the translucent midsole 11 is illuminated.

Figure 11:
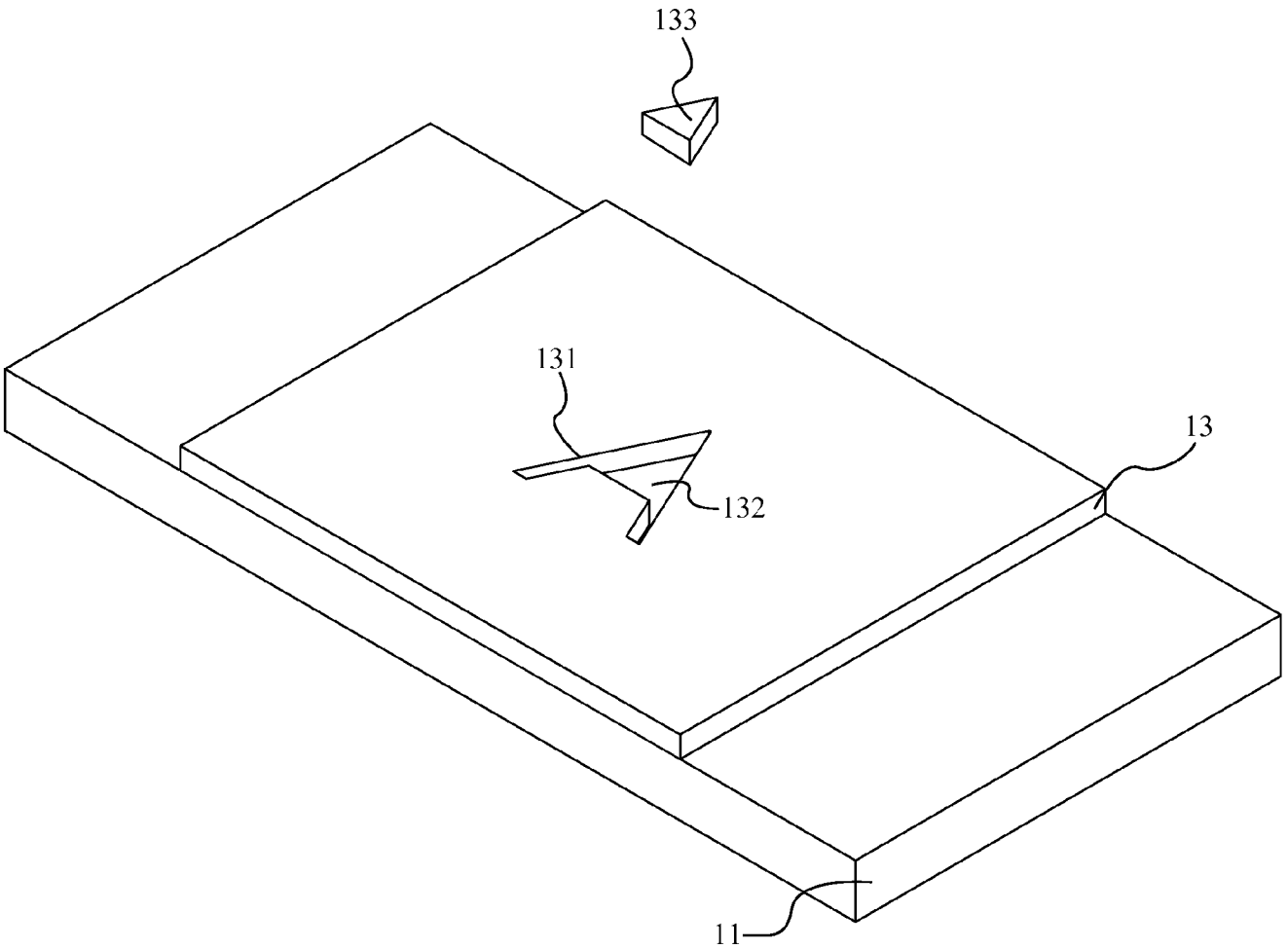
FIG. 11 is a perspective view showing a second blackout method of one embodiment of the present invention.

FIG. 11 shows a second blackout method, in which the plurality of outsole design sections 131 are cut from the outsole, just as in the first blackout method. However, in the second blackout method a plurality of filters 133, separate from both the translucent midsole 11 and the opaque outsole 13, are connected to the translucent midsole 11. These filters 133 are used when the plurality of outsole design sections 131 cannot fully replicate the intended design. For example, with letters and numbers such as "A", "O", "R", "Q", "9", and "6", there are center portions (e.g. the triangle in "A") that cannot be cut from the outsole. In this instance, the filters 133 are connected to the translucent midsole 11, aligned with the centers of the outsole design sections 131, in order to block the centers of the outsole design sections 131. Using this blackout method, the triangle in the center section of the "A" will be opaque, helping to outline the entire "A" shape. This is in contrast to the first blackout method where the translucent midsole 11 is still visible in the center section of the "A", causing the triangle to light up.

Figure 12:
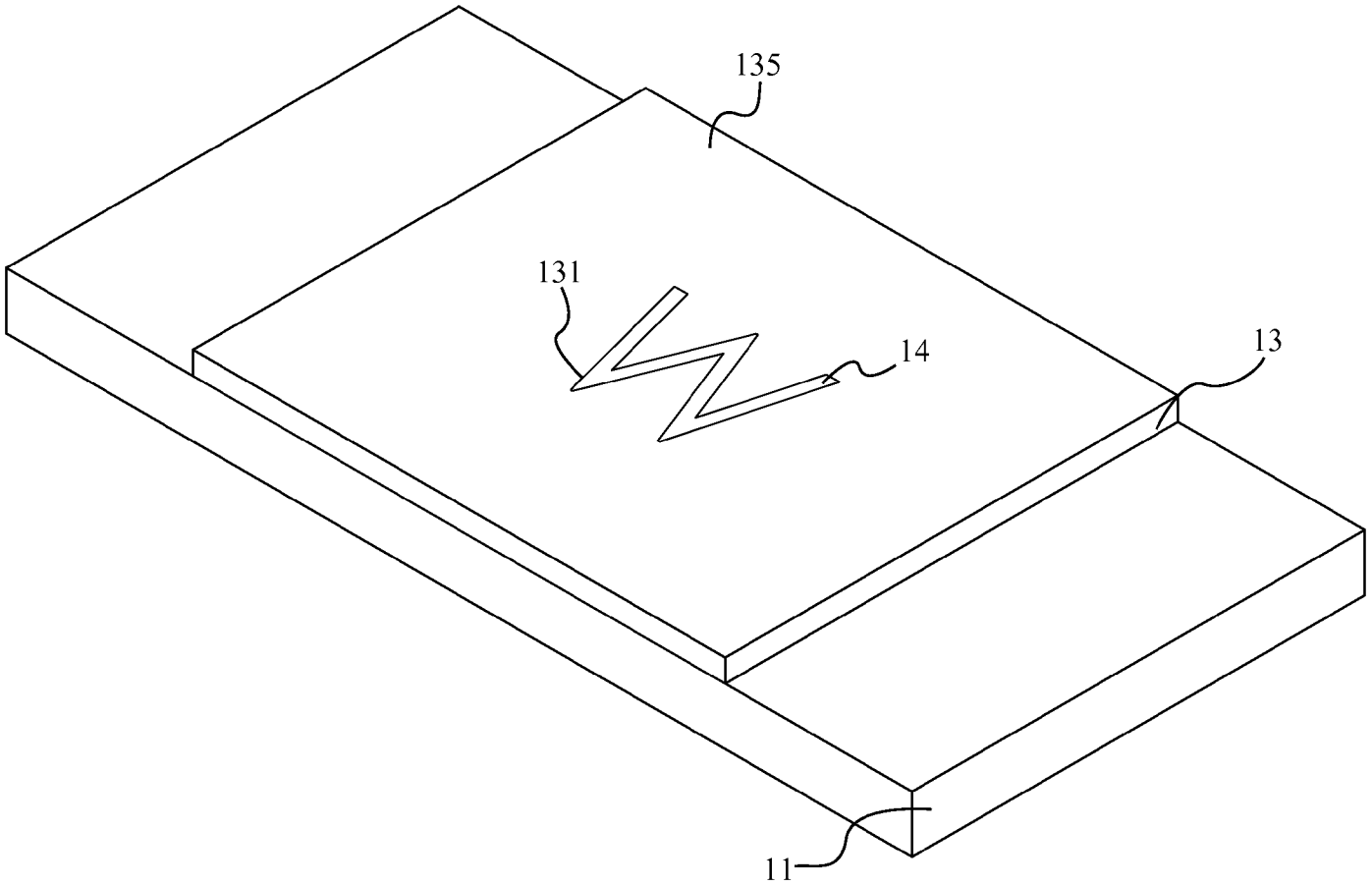
FIG. 12 is a perspective view showing a third blackout method of one embodiment of the present invention.

The third blackout method, similar to the first blackout method, cuts a plurality of outsole design sections 131 from the outsole to define a design or illustration as illustrated in FIG. 12. As with the first blackout method, the third blackout method utilizes a plurality of design inserts 14. These design inserts 14 have the same shape and size as the outsole design sections 131, and are positioned so that the design inserts 14 and outsole design sections 131 overlap when the opaque outsole 13 is connected to the translucent midsole 11. The design inserts 14 are extended from the translucent midsole 11. The depth of these design inserts 14 is equal to the depth of the cuts made into the opaque outsole 13. In other words, their depth is equal to the thickness of the opaque outsole 13. As a result, when the opaque outsole 13 is connected to the translucent midsole 11, the design inserts 14 are flush with the bottom surface 135 of the opaque outsole 13.

Figure 13:
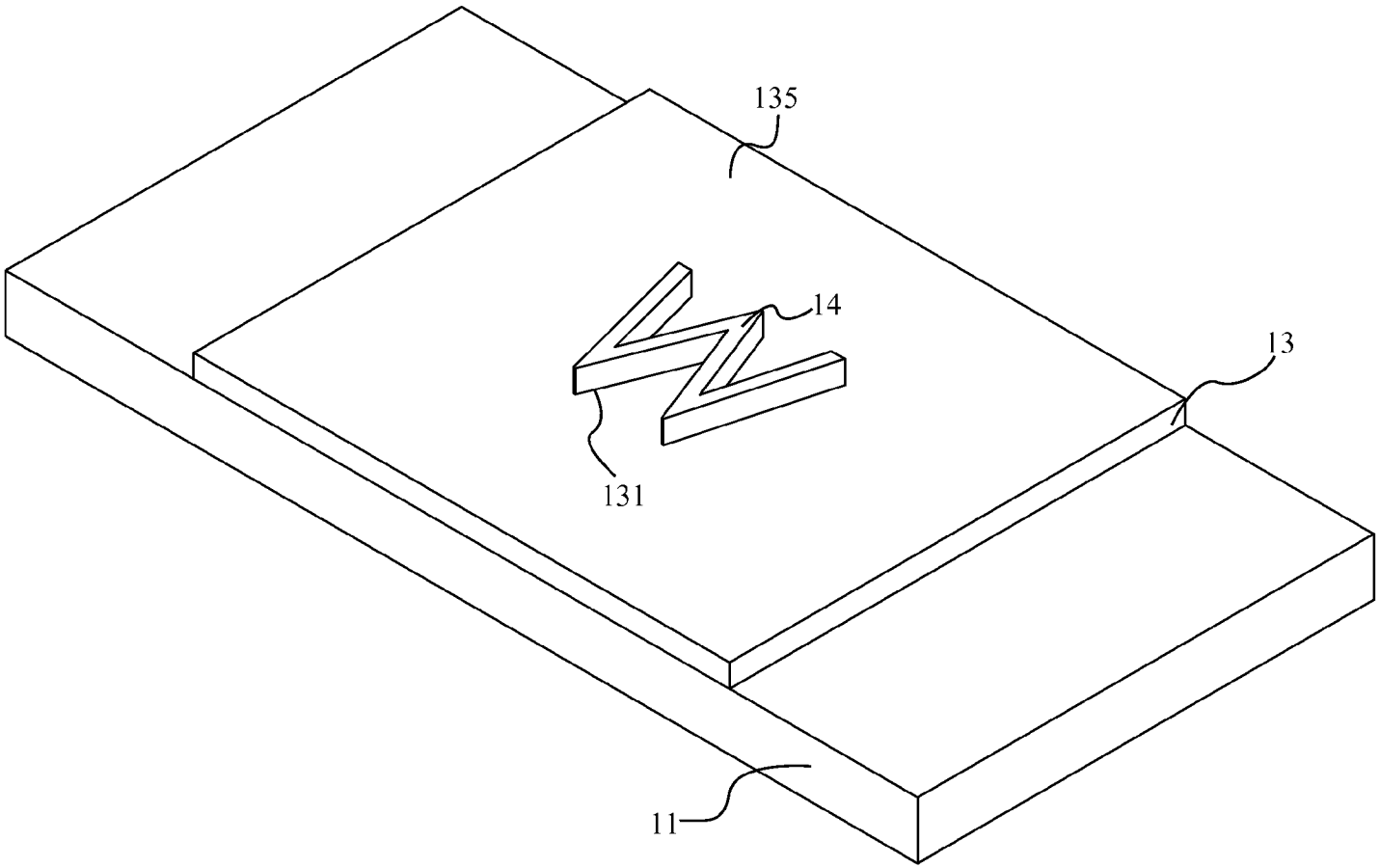
FIG. 13 is a perspective view showing a fourth blackout method of one embodiment of the present invention.

A fourth blackout method, depicted in FIG. 13, is a slight variant of the third blackout method. As with the third blackout method, a plurality of outsole design sections 131 are cut from the opaque outsole 13, while a plurality of design inserts 14 are extended from the translucent midsole 11. The difference between the third blackout method and the fourth blackout method is how far the design inserts 14 are extended. In the fourth blackout method, the design inserts 14 are extended past the opaque outsole 13. That is, the design inserts 14 have a depth greater than the thickness of the opaque outsole 13. As a result, when the opaque outsole 13 is connected to the translucent midsole 11, the design inserts 14 extend past the bottom surface 135 of the opaque outsole 13, similar to spikes.

Figure 14:
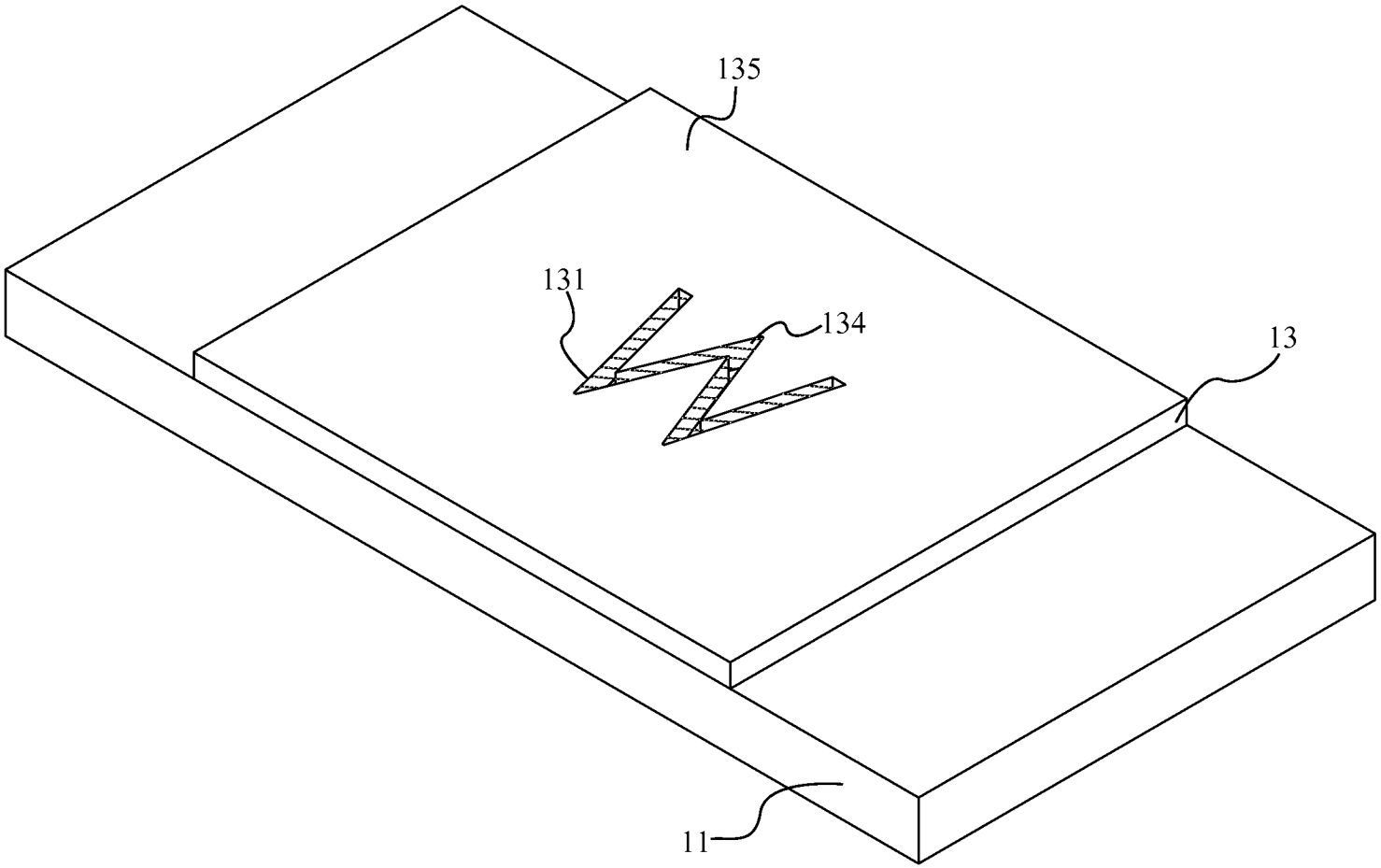
FIG. 14 is a perspective view showing a fifth blackout method of one embodiment of the present invention.

Visible in FIG. 14, the fifth blackout method employs only a plurality of outsole design sections 131. However, rather than cutting the outsole design sections 131 from the opaque outsole 13, the opaque outsole 13 is molded so that a plurality of translucent sections 134 form the outsole design sections 131; these are made from a clear or translucent material rather than an opaque material like the rest of the opaque outsole 13. This blackout method requires the use of a multicolor mold in order to create the plurality of translucent sections 134 in the opaque outsole 13. This effectively allows light from the internally illuminated translucent midsole 11 to pass through the translucent sections 134 within the opaque outsole 13, similar to the other blackout methods. Potentially, it is also possible to create "negative designs", where the designs are defined by opaque sections, and the translucent portion of the outsole creates the negative space. It's conceptually similar to writing black letters on a white background instead of writing white letters on a black background. In this instance, the outsole is molded so that the outsole design sections 131 are opaque and the rest of the outsole is translucent. As a result, the outsole is internally illuminated, like the midsole, but the designs are defined by the opaque areas of the outsole.

Figure 15:
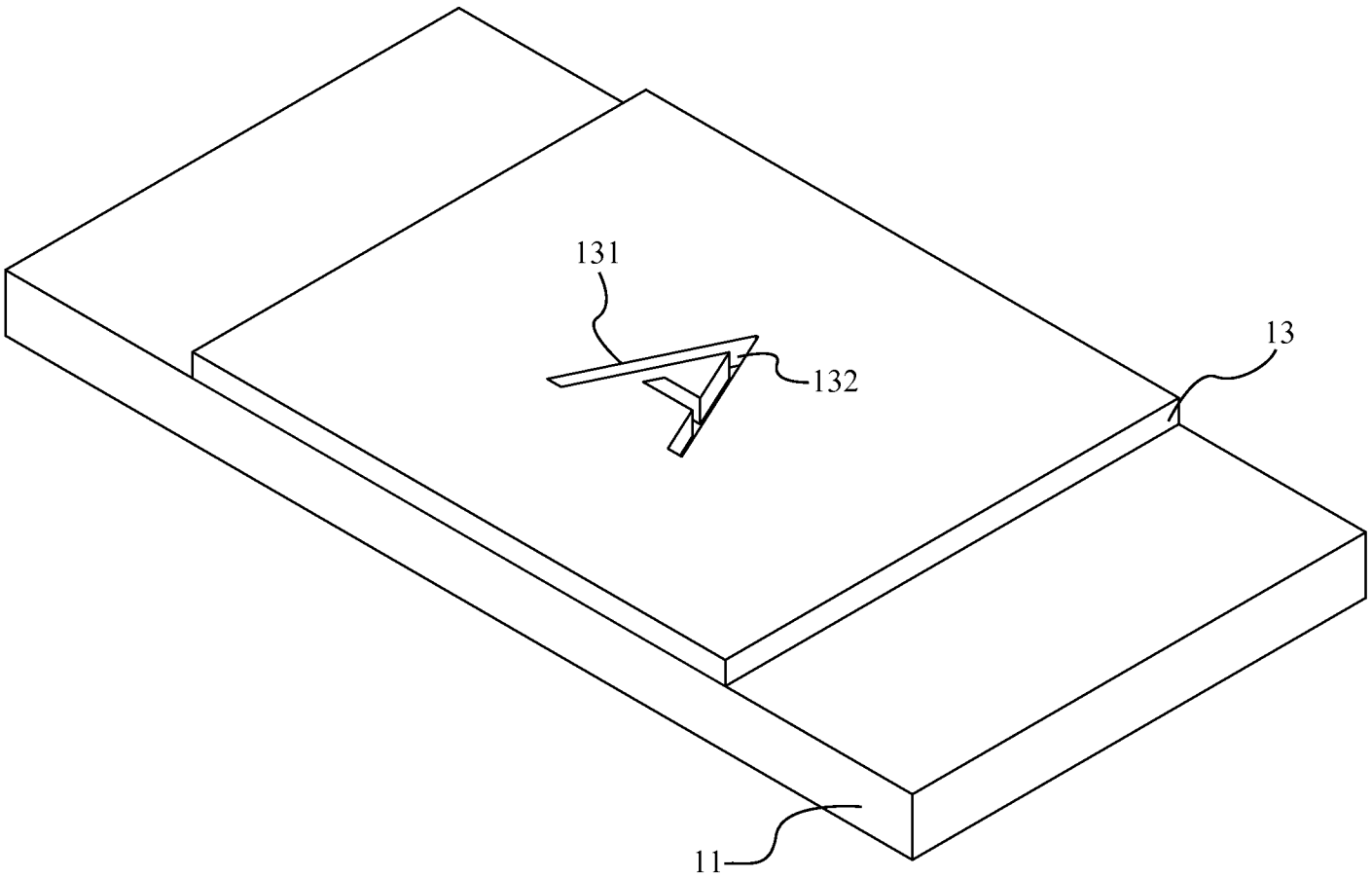
FIG. 15 is a perspective view showing a sixth blackout method of one embodiment of the present invention.

The sixth blackout method, similar to the first method, cuts the plurality of outsole design sections 131 from the opaque outsole 13. In this blackout method, the cuts are made in a stencil style, seen in FIG. 15; this is similar to the second blackout method, in that it aims to address the center areas of letters such as "A". In stenciling, such areas are referred to as islands. Islands are spaces that are surrounded by pieces that need to be cut, like the triangle shape in the aforementioned "A". Stencils solve this problem by adding bridges to the designs. These bridges connect islands to other parts of the stencil, allowing the stencil to remain as one piece while still having the design ("A", in this case) show up.

The various blackout methods can be applied anywhere along the sole section 1. It is even possible to blackout illumination from the side of the translucent midsole 11 or sole section 1, whether through a multicolor mold or by extending the opaque outsole 13 to cover parts or all of the side of the translucent midsole 11. Resultantly, designs, logos, and other arrangements could be incorporated across the sides of the sole section 1 and translucent midsole 11, an example of which can be seen in FIG. 7.

Figure 25:
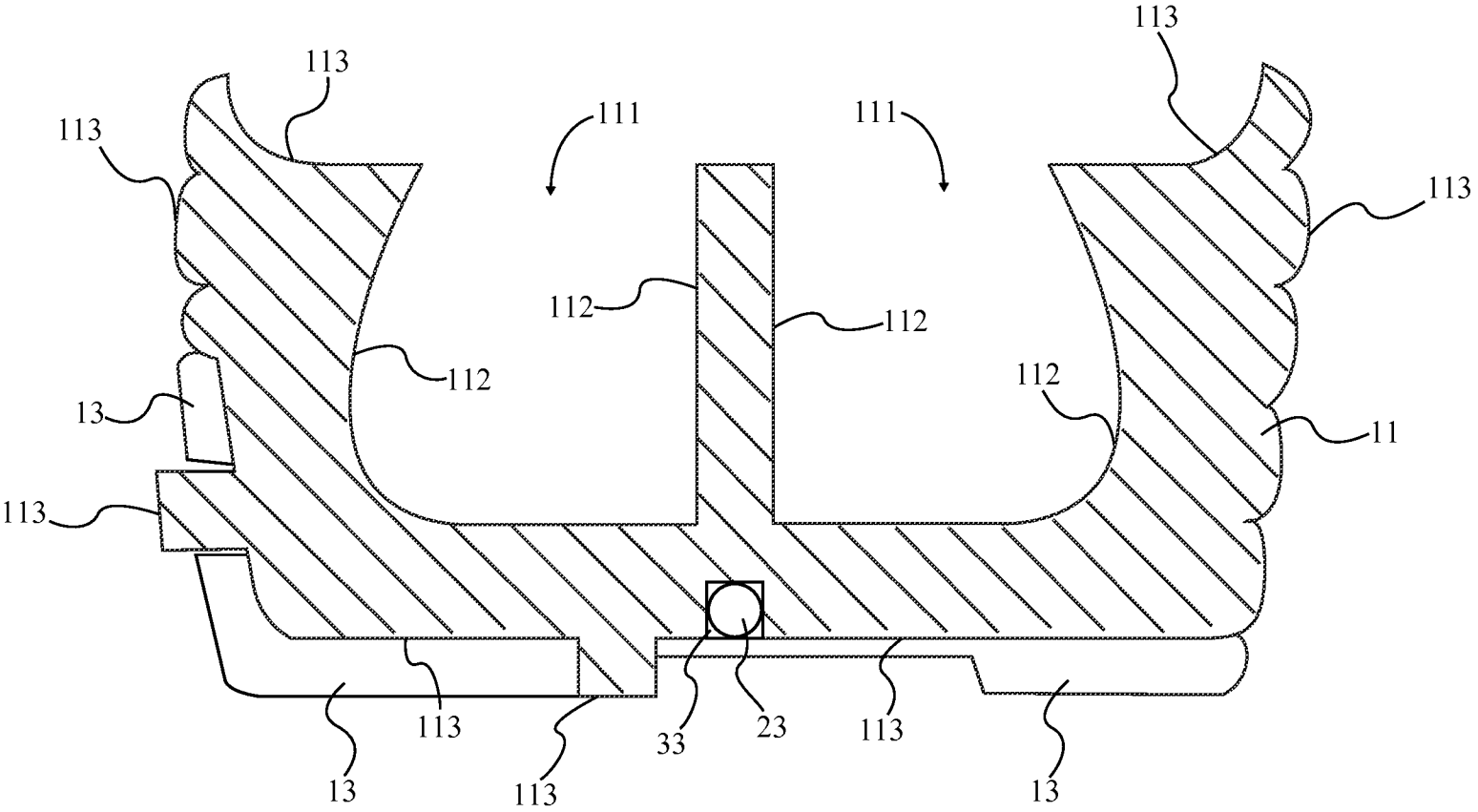
FIG. 25 is a section view showing the interior of a skeleton embodiment of the present invention.

In other embodiments the translucent midsole 11 may not be solid, but instead built with a skeleton design, resulting in a skeleton midsole. The skeleton midsole has open interior sections 111 formed by internal and external walls 113, which can be produced in various arrangements, such as those shown in FIG. 25. As with the preferred embodiment, the skeleton midsole will be a translucent midsole 11. To enhance the internal passage of light within the translucent skeleton midsole the corresponding areas of the mold, which form the interior walls of the skeleton midsole, are electroplated. This eliminates most, if not all, of the reflection or refraction of light as it relates to the internal walls 112 of the midsole. Electroplating these specific areas of the production mold, in which the translucent midsole 11 is produced, creates the smoothest and thus clearest surface possible thus enhancing the internal illumination of the midsole. In contrast with the internal walls 112, the parts of the mold corresponding to the external walls 113 are non-electroplated. In addition, the internal walls 112 curve as they meet the internal base. Similar to electroplating, curving the internal walls 112 creates an easy pathway for light to travel and promotes internal reflection and full illumination of the skeleton midsole.

Figure 26:
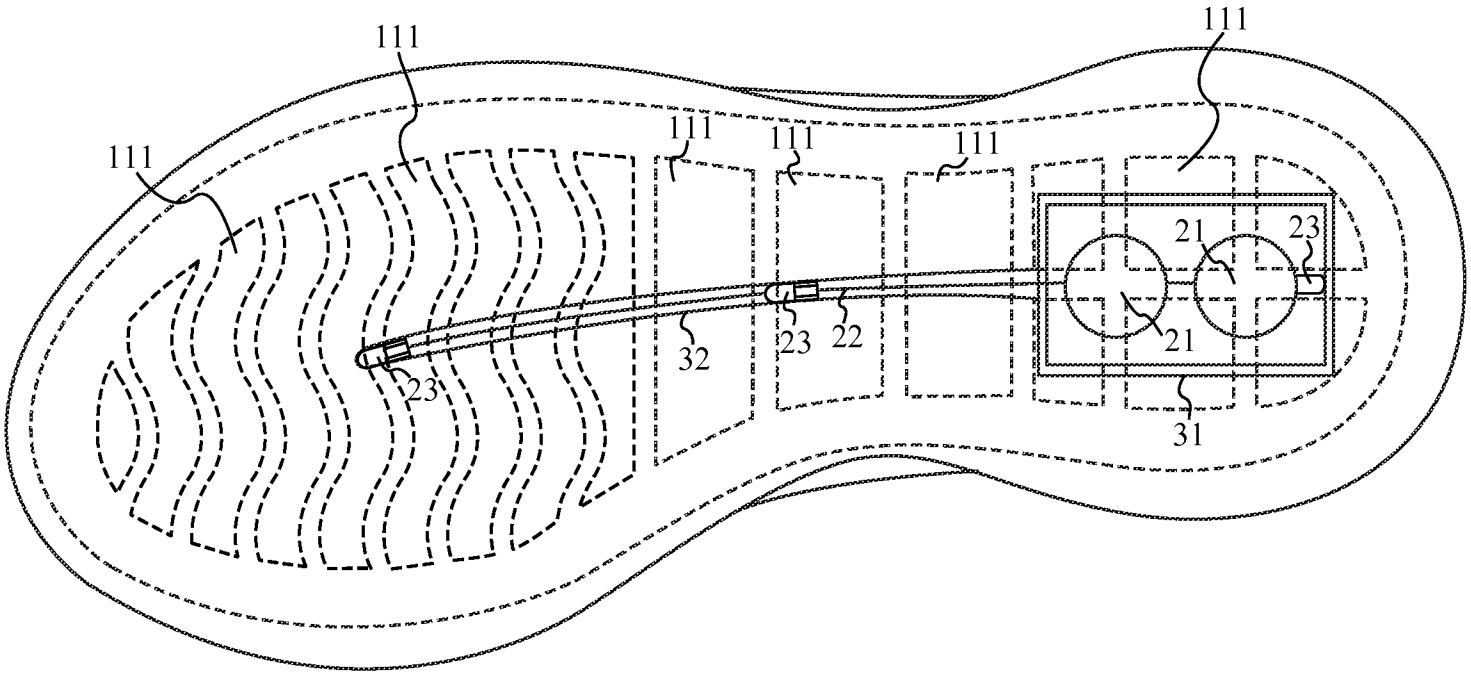
FIG. 26 is a bottom view of a left foot showing a skeleton embodiment of the present invention with a bottom mounted illumination system.
Figure 27:
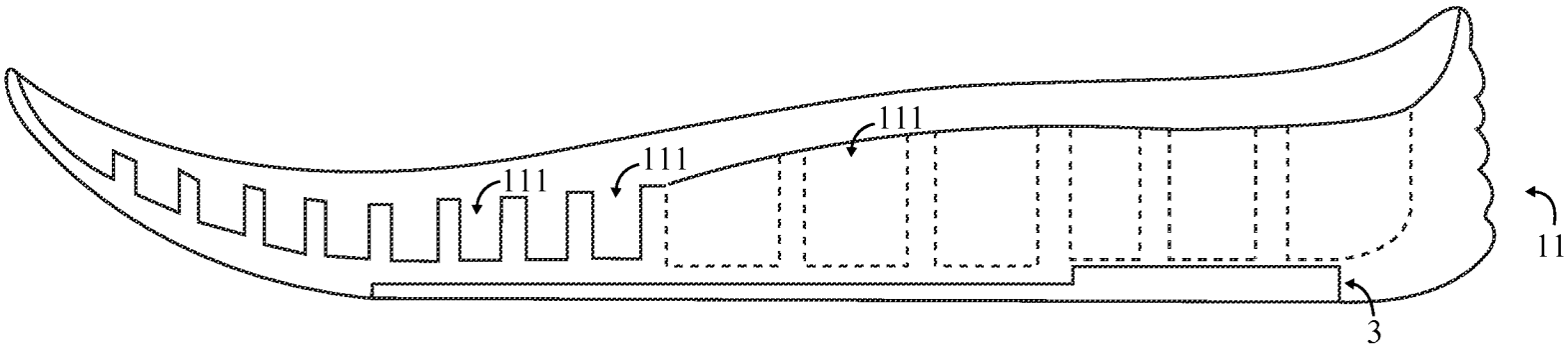
FIG. 27 is a split view from heel to toe showing a skeleton embodiment of the present invention with a bottom mounted illumination system.
Figure 28:
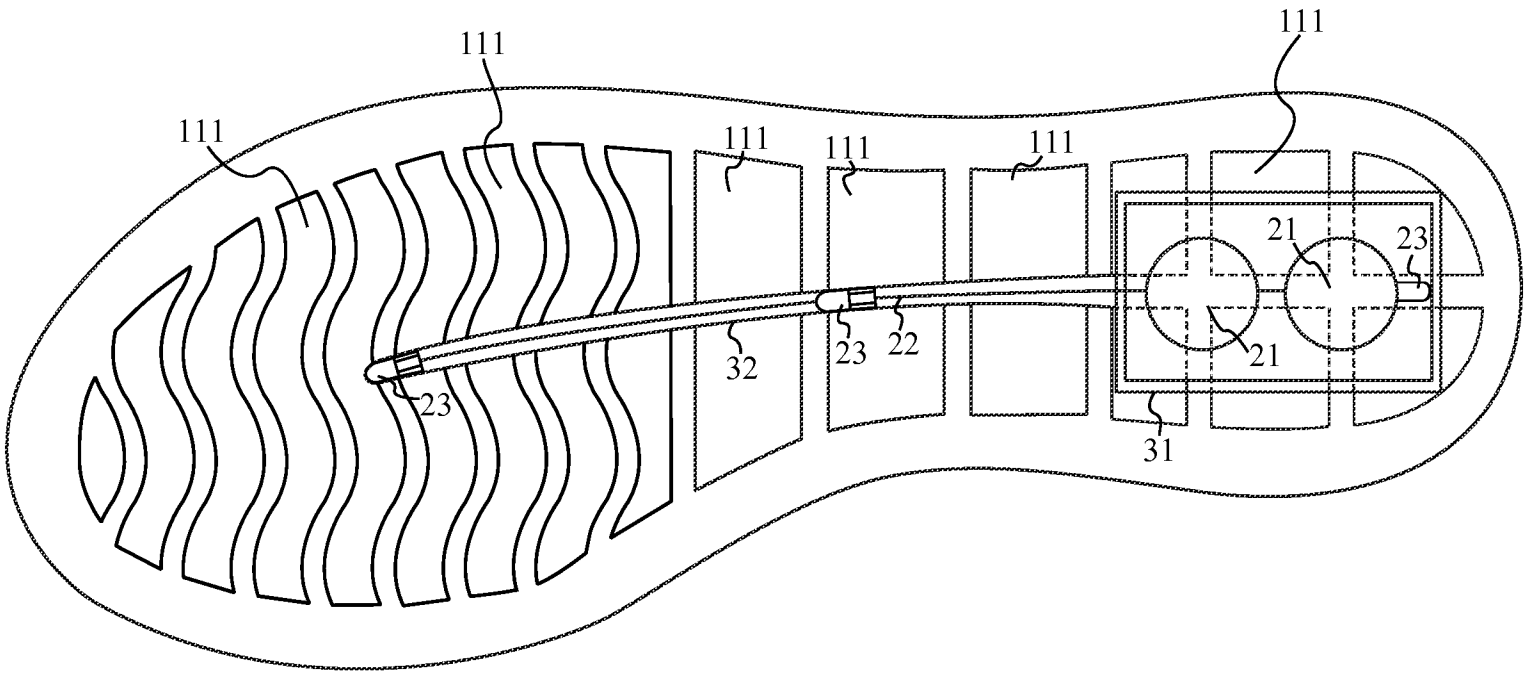
FIG. 28 is a top view of a right foot showing a skeleton embodiment of the present invention with a top mounted illumination system.
Figure 29:
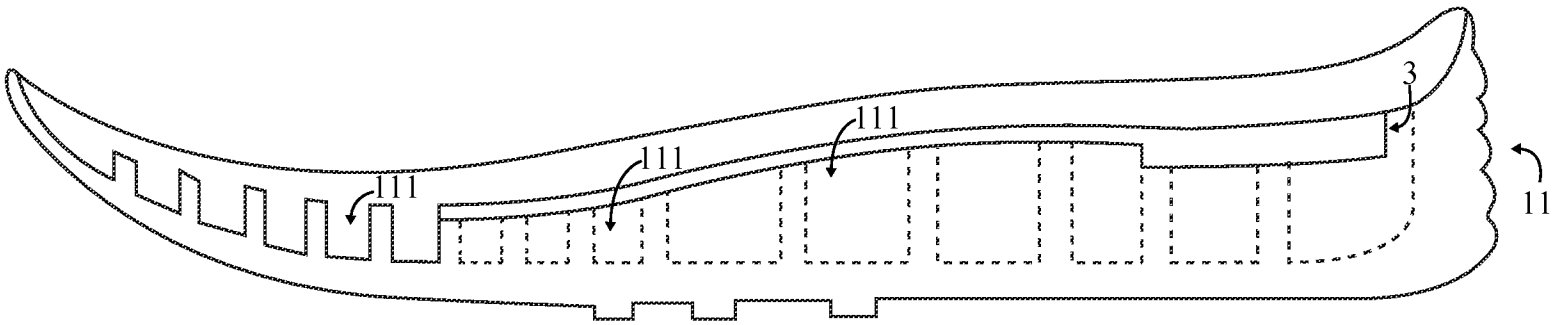
FIG. 29 is a split view from heel to toe showing a skeleton embodiment of the present invention with a top mounted illumination system.

When employing a skeleton midsole there are three variations in how the illumination system 2, skeleton midsole, opaque outsole 13, and outsole design sections 131 are combined and arranged. In a first variation, the illumination system 2 is installed in the bottom of the skeleton midsole, with the outsole design sections 131 being positioned to overlap with the plurality of illumination sources 23. In a second variation, the illumination system 2 is also installed in the bottom of the skeleton midsole, but the outsole design sections 131 do not overlap the plurality of illumination sources 23. Examples of a bottom mounted illumination system 2 are shown in FIG. 26 and FIG. 27. In a third variation, the illumination system 2 is installed in the top of the skeleton midsole, while the outsole design sections 131 can be positioned anywhere; this variation works the same whether or not the outsole design sections 131 overlap the illumination sources 23. Examples of a top mounted illumination system 2 are seen in FIG. 28 and FIG. 29.

Figure 16:
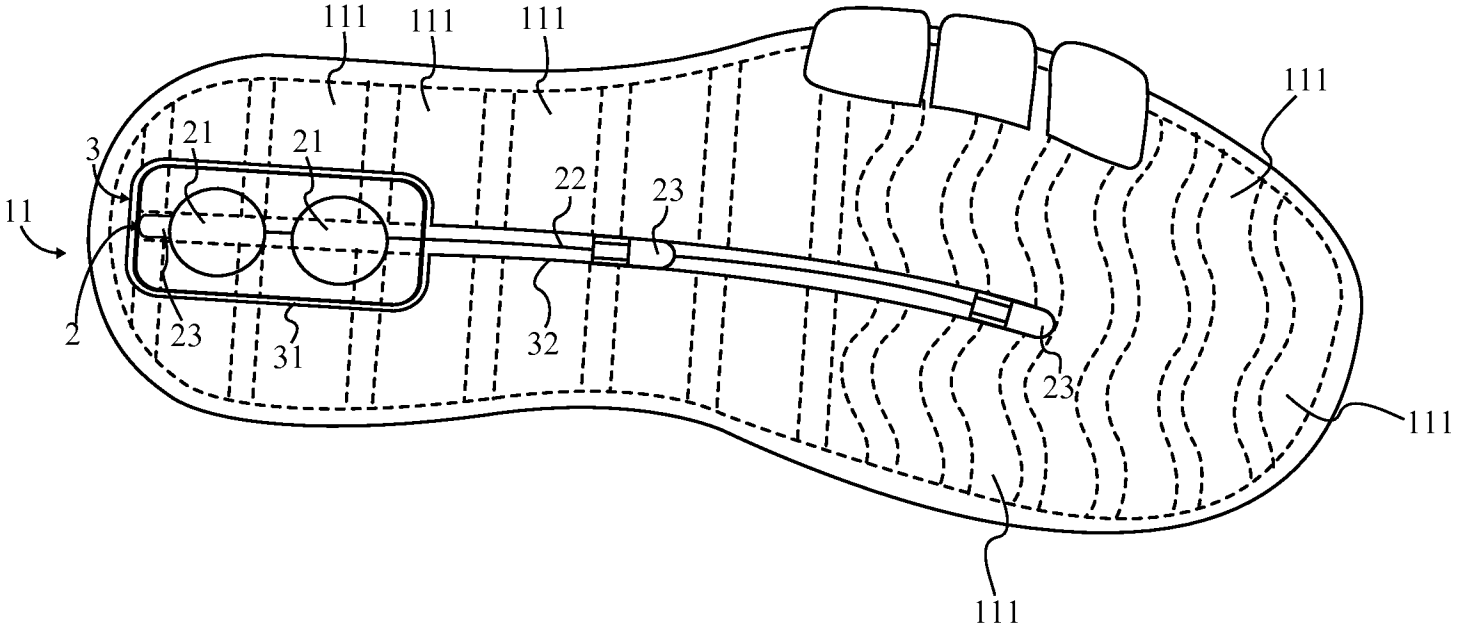
FIG. 16 is a bottom view of a right foot skeleton midsole design of a first skeleton embodiment of the present invention with a bottom mounted illumination system.
Figure 17:
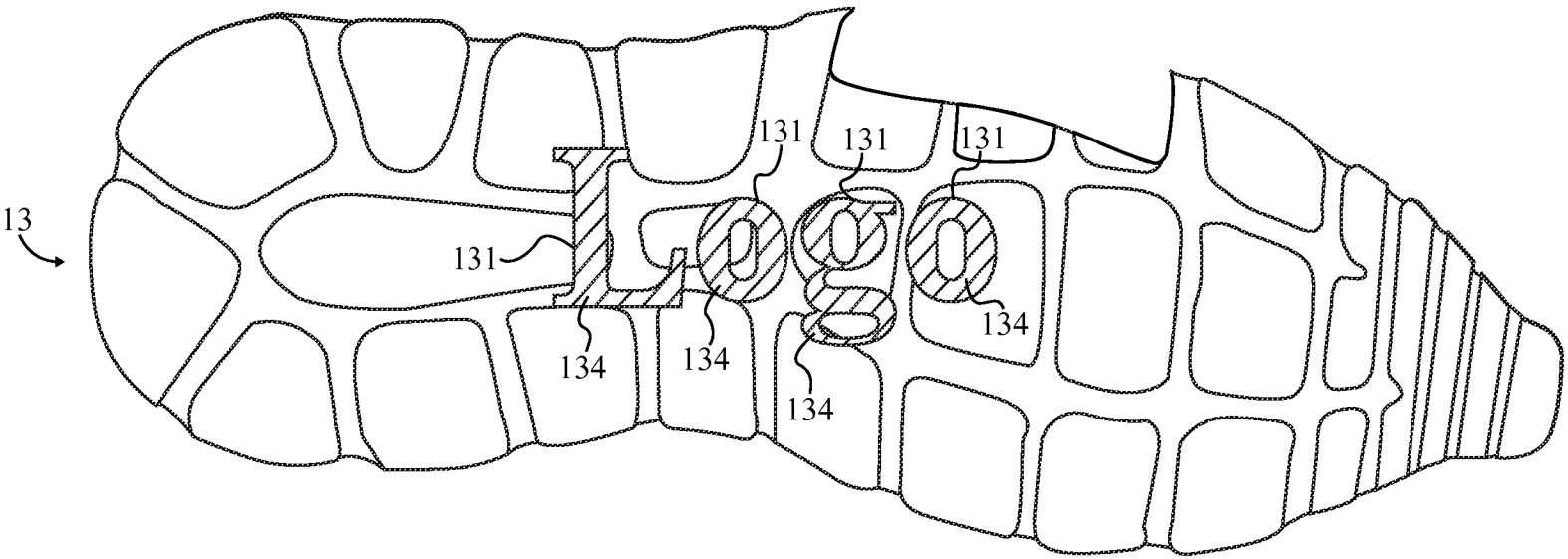
FIG. 17 is a bottom view of an outsole design of a first skeleton embodiment of the present invention, which embodies blackout method 5.
Figure 18:
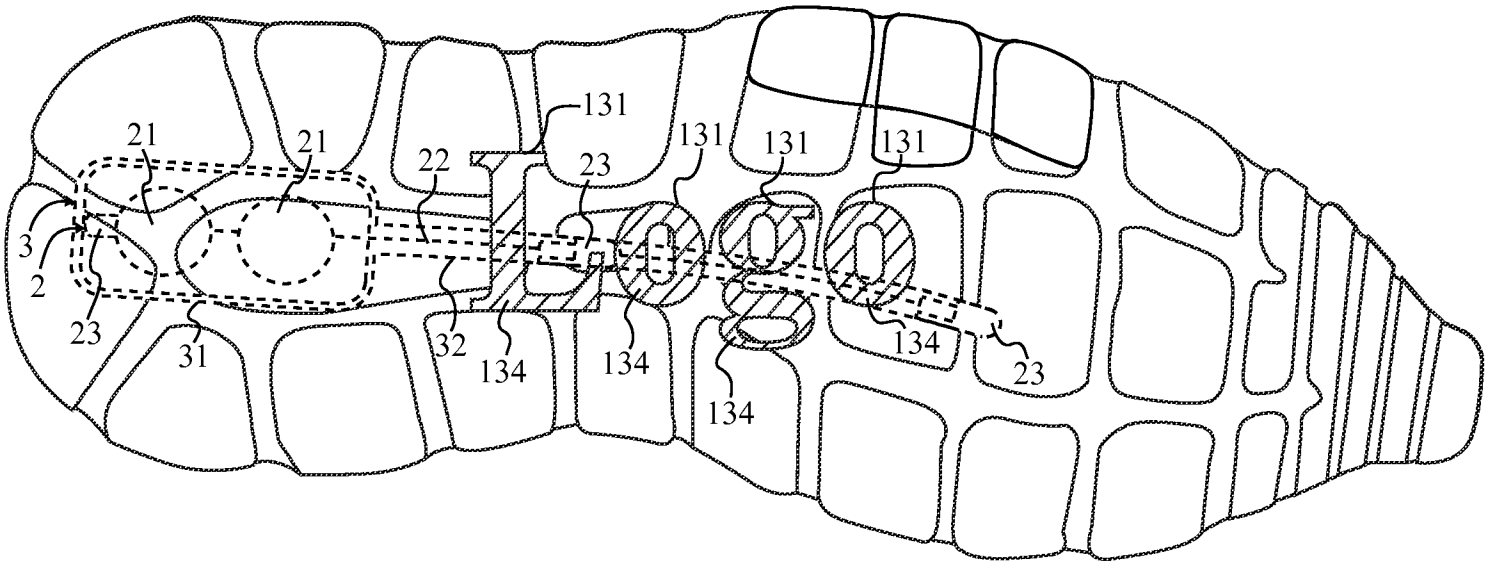
FIG. 18 is a bottom view of a combined skeleton midsole and outsole of a first skeleton embodiment of the present invention, which embodies blackout method 5.

In the first variation, the outsole (FIG. 17) connects to the skeleton midsole (FIG. 16), with the outsole design sections 131 overlapping a portion of the illumination system 2 and illumination sources 23, as shown in FIG. 18. Given that blackout methods 1 through 4 and 6 would result in exposing the illumination housing 3 and illumination system 2, only blackout method 5, which uses multicolor molding for the outsole, will function properly in this variation.

Figure 19:
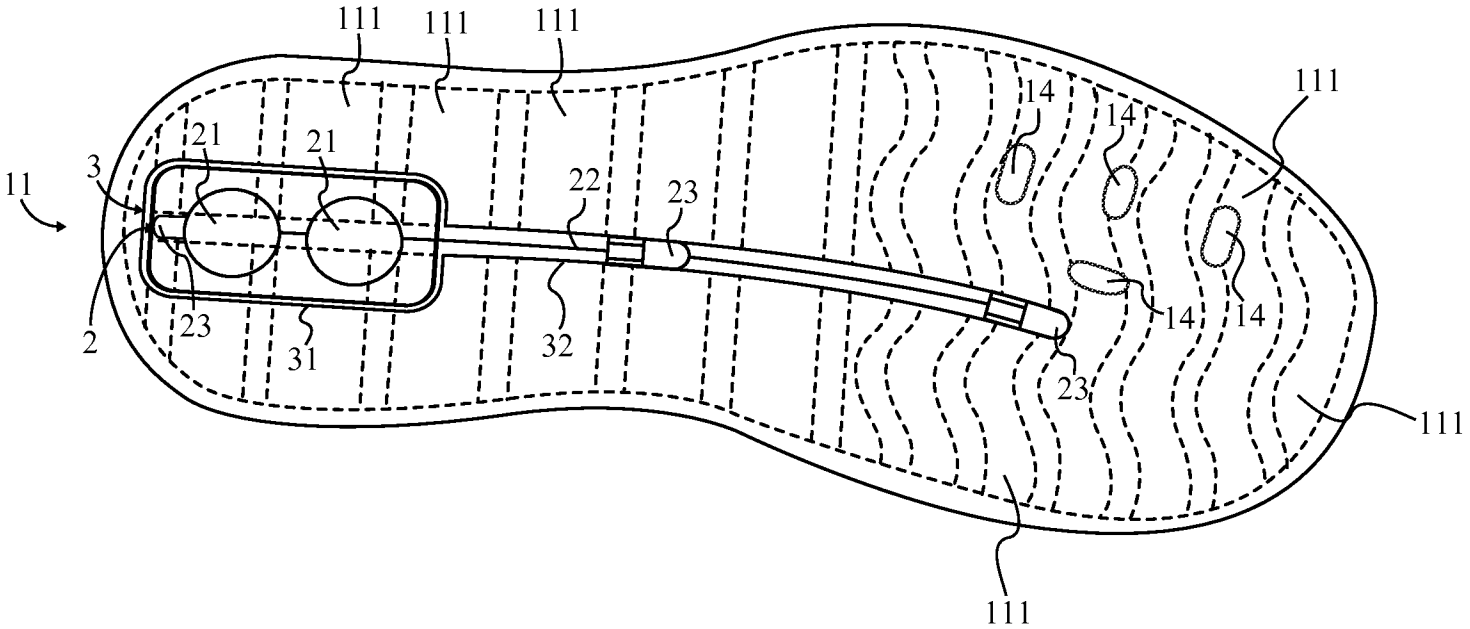
FIG. 19 is a bottom view of a right foot skeleton midsole design of a second skeleton embodiment of the present invention with a bottom mounted illumination system and a midsole which embodies blackout method 1.
Figure 20:
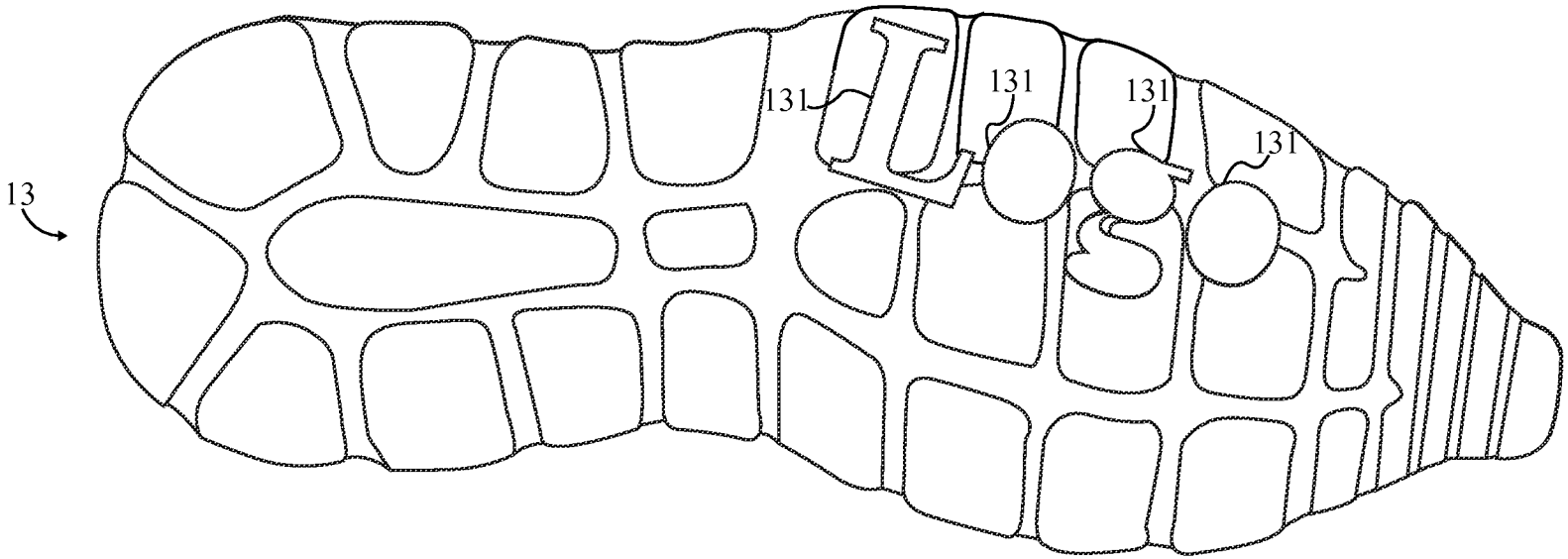
FIG. 20 is a bottom view of an outsole design of a second skeleton embodiment of the present invention, which embodies blackout method 1.
Figure 21:
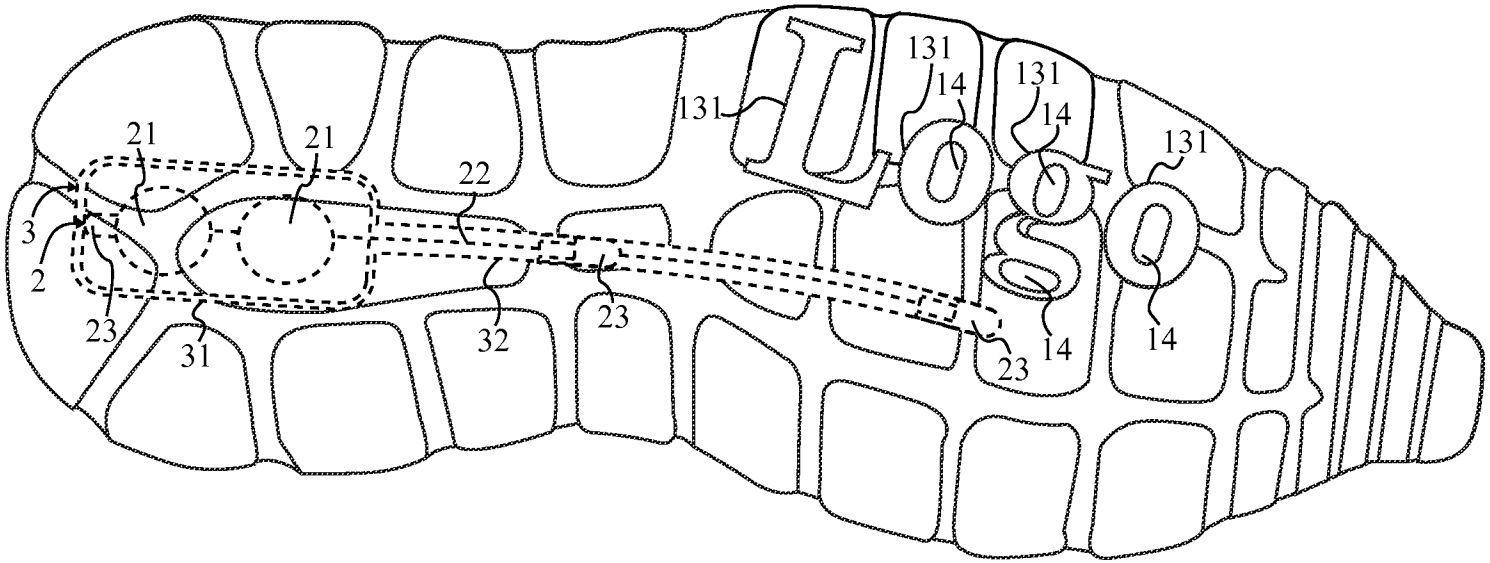
FIG. 21 is a bottom view of a combined skeleton midsole and outsole of a second skeleton embodiment of the present invention, which embodies blackout method 1.

In the second variation, as with the first variation, the outsole (FIG. 20) is connected to the midsole (FIG. 19) adjacent to the illumination system 2. However, unlike the first variation, the outsole design sections 131 do not overlap with the illumination system 2, as shown in FIG. 21. As a result, cuts, like used with many of the blackout methods, can be made into the opaque outsole 13 without exposing the illumination housing 3 and illumination system 2. This means that each discussed blackout method, 1-6, will function properly in this second variation. Even methods such as blackout method 1, where design inserts 14 are molded into the skeleton midsole, will work.

Figure 22:
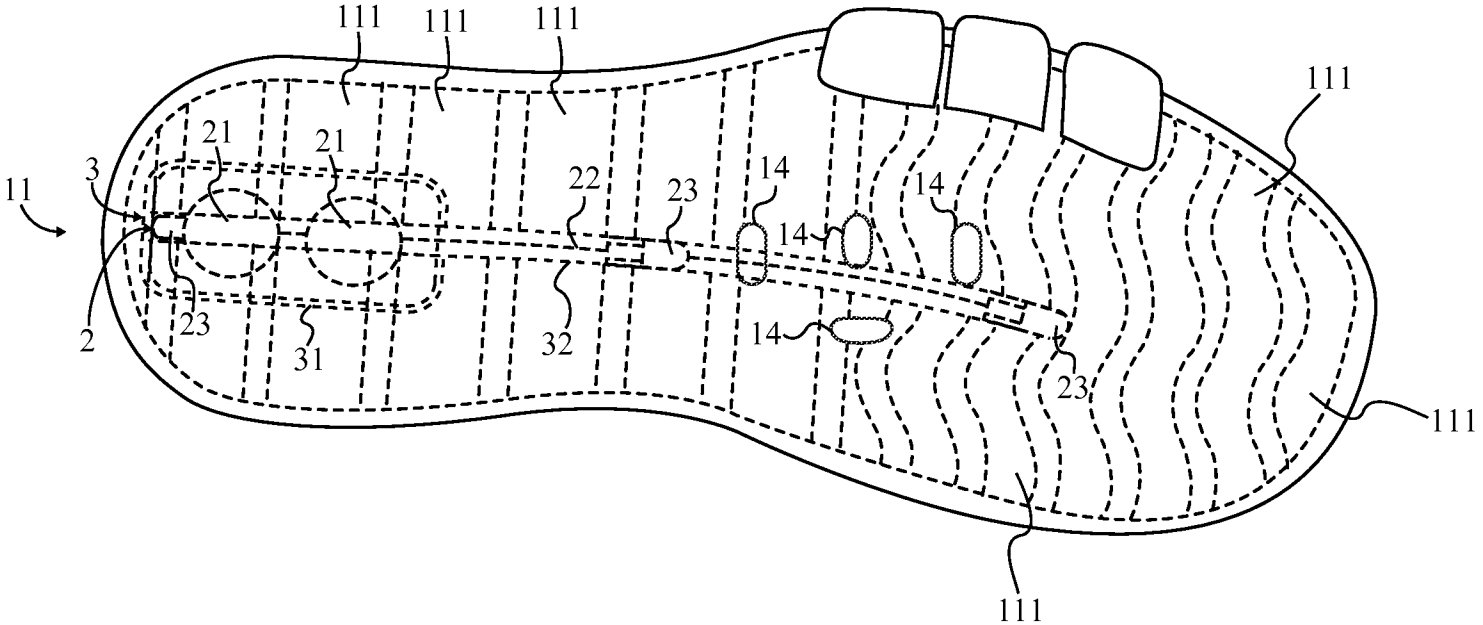
FIG. 22 is a bottom view of a right foot skeleton midsole design of a third skeleton embodiment of the present invention with a top mounted illumination system and a midsole which embodies blackout method 1.
Figure 23:
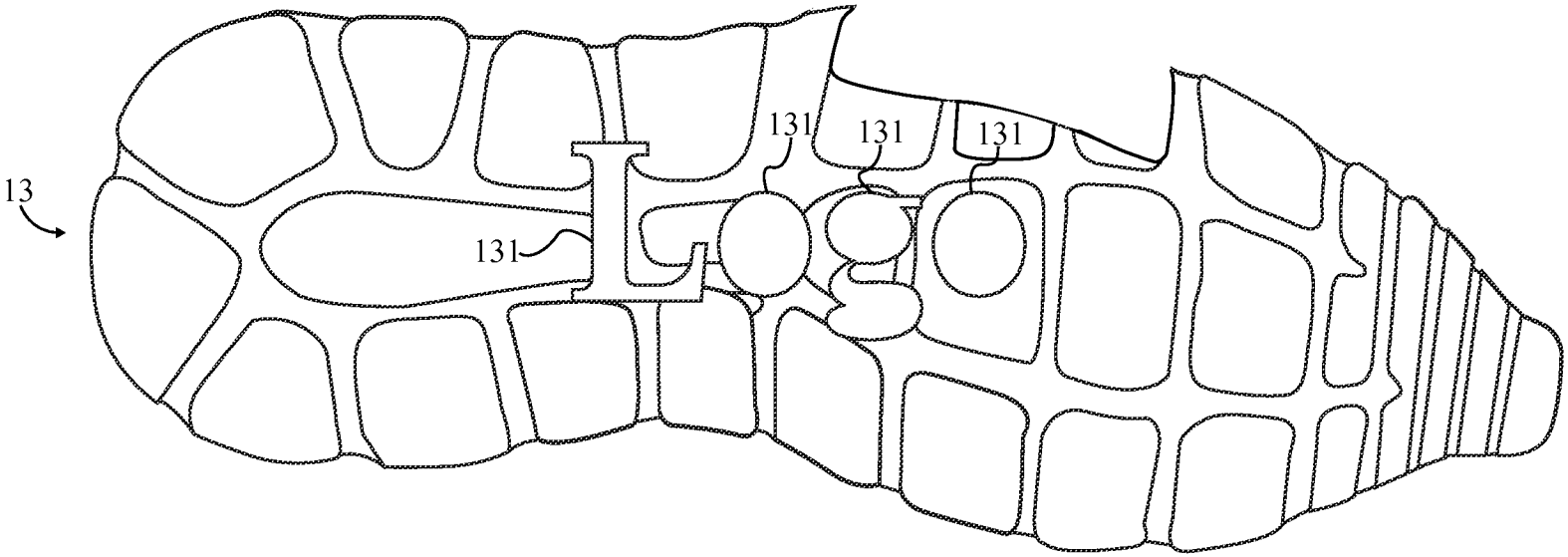
FIG. 23 is a bottom view of an outsole design of a third skeleton embodiment of the present invention, which embodies blackout method 1.
Figure 24:
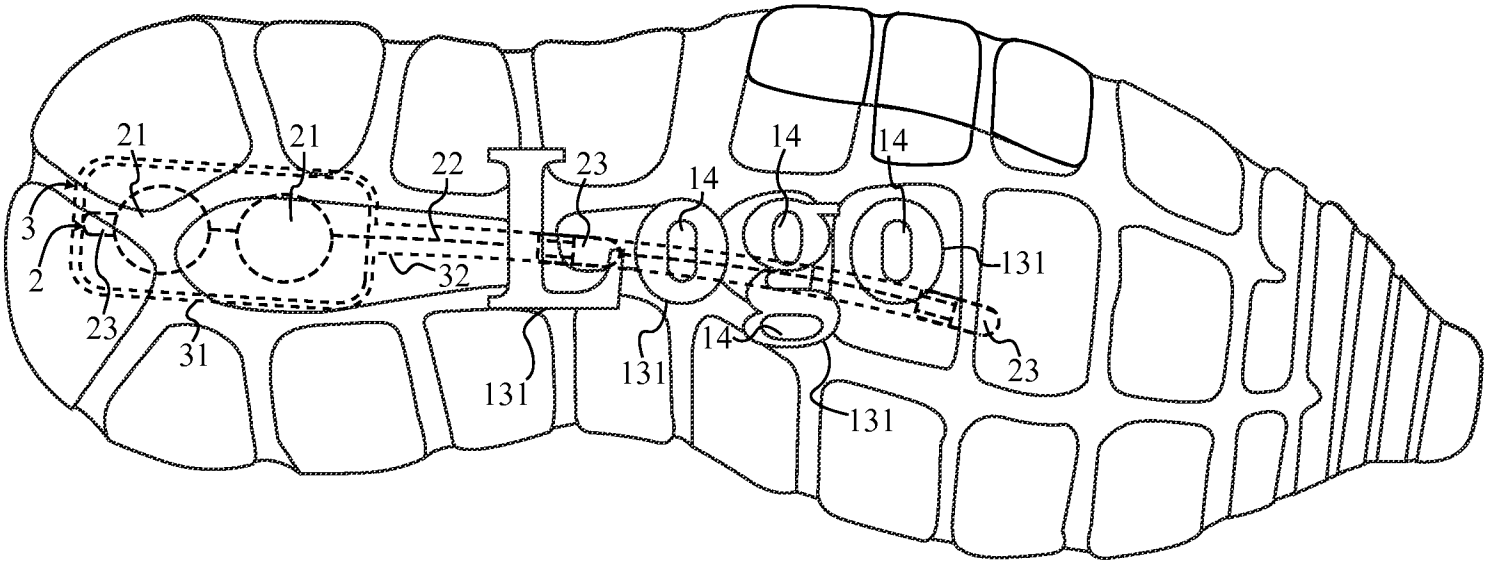
FIG. 24 is a bottom view of a combined skeleton midsole and outsole of a third skeleton embodiment of the present invention, which embodies blackout method 1.

In the third variation, the outsole (FIG. 23), as always, is connected to the bottom of the midsole (FIG. 22) to create the full sole section 1 (FIG. 24). The illumination system 2, on the other hand, is installed in the top section of the skeleton midsole. As a result, the illumination system 2 will not interfere with the outsole design sections 131, regardless of whether the outsole design section 131 overlaps the illumination system 2 or not. As with the second variation, this means that any of the blackout methods can be successfully applied to this third variation.

Figure 30:
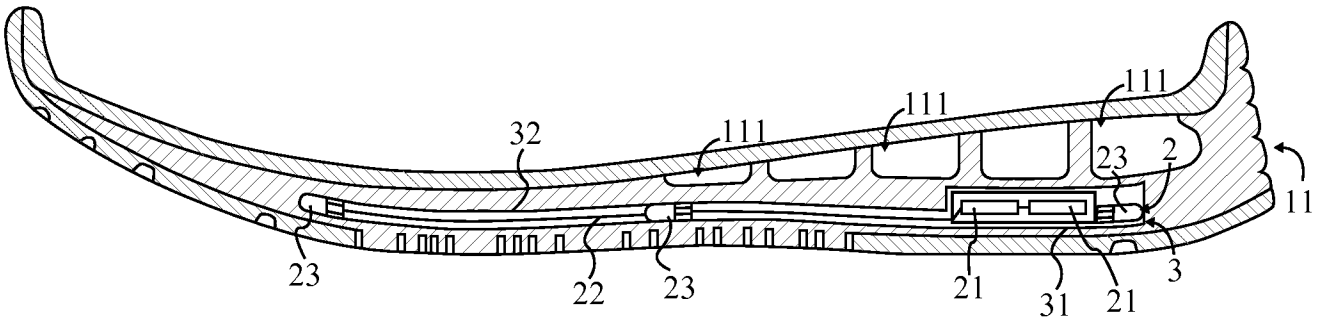
FIG. 30 is a split view from heel to toe showing a partial skeleton midsole embodiment of the present invention.

In addition to the mentioned embodiments there are a multitude of slight variations that could be made to the present invention. While a preferred solid midsole and a skeleton midsole have been described, the two concepts could be combined in a single design, such as in FIG. 30. In this combined midsole the front portion of the combined midsole is solid while the rear portion comprises a low profile skeleton. In this variation the illumination system 2 can be placed in the illumination housing 3 during the multicolor molding process, and permanently secured in place during an injection process. In another example, the outsole does not need to completely cover the translucent midsole 11. Parts of the translucent midsole 11 could be incorporated as part of the sole, where sections of the translucent midsole 11 protrude from the rest of the midsole and form a flush bottom surface 135 with the outsole. Examples of this are visible in FIG. 16, FIG. 18, FIG. 22, and FIG. 24. Potentially, the translucent midsole 11 could be hollowed out and designed to fill with water, providing an alternative visual experience. However, this would require sealing the translucent midsole 11 from the illumination housing 3, as well as providing a way to fill the translucent midsole 11 with water. A simpler change is placing a dispersive prism facing the illumination source 23, refracting the light and further enhancing the visual experience.

Although the invention has been explained in relation to its preferred embodiment, it is to be understood that many other possible modifications and variations can be made without departing from the spirit and scope of the invention as hereinafter claimed.

What is claimed is:

1. An internally illuminated footwear component comprises, a sole section;

the sole section comprises a translucent midsole and an opaque outsole;

an illumination system;

the illumination system comprises a power source, a plurality of electrical wires, and a plurality of illumination sources;

an illumination housing;

the translucent midsole being positioned atop and connected to the opaque outsole;

the power source being electrically connected to the plurality of illumination sources;

the illumination housing being positioned inside the translucent midsole;

the illumination system being located within the illumination housing;

the illumination housing comprises a power section, a plurality of channels, and a plurality of illumination sections;

the power source being positioned within the power section;

the plurality of illumination sources being positioned within the plurality of illumination sections;

the plurality of electrical wires being positioned in the plurality of channels;

the power section being connected to the plurality of illumination sections by the plurality of channels;

the plurality of electrical wires being electrically connected to the power source and the plurality of illumination sources;

the opaque outsole comprises a plurality of outsole design sections; and the plurality of outsole design sections traverse through the opaque outsole, wherein the translucent midsole is visible through the plurality of outsole design sections, and the plurality of outsole design sections is a plurality of cavities in the opaque outsole or the plurality of outsole design sections is a plurality of translucent sections in the opaque outsole;

the translucent midsole comprises a plurality of open interior sections, a plurality of internal walls, and a plurality of external walls, wherein the translucent midsole is of a skeleton design;

the plurality of open interior sections being positioned within the translucent midsole;

the plurality of internal walls being positioned around the plurality of open interior sections;

the plurality of external walls being contourly positioned around the translucent midsole; and the plurality of external walls laterally surrounding the translucent midsole.

2. The internally illuminated footwear component as claimed in claim 1 comprises, a plurality of design inserts;

the plurality of design inserts being connected adjacent to the translucent midsole; and the plurality of design inserts being aligned with the plurality of outsole design sections.

3. The internally illuminated footwear component as claimed in claim 2 comprises, the plurality of design inserts traversing from the translucent midsole into the plurality of outsole design sections, wherein the plurality of design inserts are shorter than the plurality of outsole design sections.

4. The internally illuminated footwear component as claimed in claim 2 comprises, the plurality of design inserts traversing from the translucent midsole through the plurality of outsole design sections, wherein the plurality of design inserts are flush with a bottom surface of the opaque outsole.

5. The internally illuminated footwear component as claimed in claim 2 comprises, the plurality of design inserts traversing from the translucent midsole out of the plurality of outsole design sections, wherein the plurality of design inserts are longer than the plurality of outsole design sections.

6. The internally illuminated footwear component as claimed in claim 1, wherein the skeleton midsole design and a solid midsole design are combined to form a partial skeleton midsole design.

7. The internally illuminated footwear component as claimed in claim 1 comprises, the translucent midsole and the opaque outsole being integrally molded to form the sole section.

8. The internally illuminated footwear component as claimed in claim 1 comprises, the translucent midsole and the opaque outsole being separately molded, wherein the translucent midsole is connected to the opaque outsole in order to form the sole section.

9. The internally illuminated footwear component as claimed in claim 1, wherein a front portion of a combined midsole is solid while a rear portion of the combined midsole comprises a low profile skeleton, the illumination system is placed in the illumination housing during the multicolor molding process, and permanently secured in place during an injection process.

10. The internally illuminated footwear component as claimed in claim 1, wherein parts of the midsole are incorporated and protrude from the midsole to form a flush bottom surface with the outsole.

* * * * *